US008181580B2

(12) United States Patent
Roth et al.

(10) Patent No.: US 8,181,580 B2
(45) Date of Patent: May 22, 2012

(54) COMPOSITE STRUCTURAL MATERIAL AND METHOD OF MAKING THE SAME

(75) Inventors: Arthur J. Roth, Orinda, CA (US); Gregory M. Palmer, Colgate, WI (US)

(73) Assignee: Coda Capital Mangement Group, LLC, Orinda, CA (US)

( * ) Notice: Subject to any disclaimer, the term of this patent is extended or adjusted under 35 U.S.C. 154(b) by 1066 days.

(21) Appl. No.: 11/813,060

(22) PCT Filed: Dec. 29, 2005

(86) PCT No.: PCT/US2005/047194

§ 371 (c)(1),
(2), (4) Date: Jun. 28, 2007

(87) PCT Pub. No.: WO2006/071920

PCT Pub. Date: Jul. 6, 2006

(65) Prior Publication Data

US 2008/0098935 A1 May 1, 2008

Related U.S. Application Data

(60) Provisional application No. 60/639,804, filed on Dec. 29, 2004.

(51) Int. Cl.
*B65D 19/38* (2006.01)

(52) U.S. Cl. ..... 108/57.25

(58) Field of Classification Search ..... 108/57.25, 108/51.11, 57.26, 57.28, 901, 902; 264/45.3, 264/46.4; 108/901, 902
See application file for complete search history.

(56) References Cited

U.S. PATENT DOCUMENTS 3,719,157 A * 3/1973 Arcocha et al. ..... 108/57.25
3,756,901 A 9/1973 Veneziale, Jr.
3,894,686 A 7/1975 Weinberg et al.
(Continued)

FOREIGN PATENT DOCUMENTS

AT 383 989 9/1987
(Continued)

OTHER PUBLICATIONS

Chun-Liang Lin, Timothy Loew, and C.K.H. Dharan, "Low-Cost Ceramic/Polyester Foam Composite Material," presented at the 40th Structures, Structural Dynamics, and Materials Conference of the American Institute of Aeronautics and Astronautics (1999).

(Continued)

*Primary Examiner* — Jose V Chen
(74) *Attorney, Agent, or Firm* — Fitzpartick, Cella, Harper & Scinto

(57) ABSTRACT

A composite structural material suitable, for example, as a replacement for wooden boards, sheets, or posts, is disclosed. It comprises a dimensionally stable core material substantially surrounded by a dimensionally stable, laminar covering that is adherent to the core material. The laminar covering is comprised of at least one band of substantially parallel reinforcing cords bonded to at least one layer of a dimensionally stable web material selected from the group consisting of rigidified paper and rigidified cloth. Preferably the band of reinforcing cords is sandwiched between two layers of rigidified paper or cloth. The core material can be, for example, a foamed synthetic resin with or without filler. A continuous process for manufacturing the material is disclosed.

21 Claims, 11 Drawing Sheets

U.S. PATENT DOCUMENTS

| | | | | | |
|---|---|---|---|---|---|
| 3,930,100 | A | | 12/1975 | McDonald | |
| 3,978,263 | A | | 8/1976 | Wellensiek | |
| 4,003,408 | A | | 1/1977 | Turner | |
| 4,028,288 | A | | 6/1977 | Turner | |
| 4,110,420 | A | | 8/1978 | Turner | |
| 4,112,176 | A | | 9/1978 | Bailey | |
| 4,183,505 | A | | 1/1980 | Maestri | |
| 4,230,049 | A | * | 10/1980 | Horne | 108/57.28 |
| 4,286,030 | A | | 8/1981 | Moore | |
| 4,467,728 | A | * | 8/1984 | Horne | 108/57.28 |
| 4,709,781 | A | | 12/1987 | Scherzer | |
| 4,743,323 | A | | 5/1988 | Hettinga | |
| 4,833,205 | A | | 5/1989 | Bauman et al. | |
| 4,848,058 | A | | 7/1989 | Mullen | |
| 4,851,500 | A | | 7/1989 | Lalwani et al. | |
| 5,010,122 | A | | 4/1991 | Koski | |
| 5,042,397 | A | * | 8/1991 | Fiedler | 108/57.18 |
| 5,193,692 | A | | 3/1993 | Farley et al. | |
| 5,238,633 | A | | 8/1993 | Jameson | |
| 5,238,734 | A | | 8/1993 | Murray | |
| 5,254,405 | A | | 10/1993 | Panaroni et al. | |
| 5,258,222 | A | | 11/1993 | Crivelli | |
| 5,259,695 | A | | 11/1993 | Mostkoff | |
| 5,312,573 | A | | 5/1994 | Rosenbaum et al. | |
| 5,316,708 | A | | 5/1994 | Drews | |
| 5,362,545 | A | | 11/1994 | Tingley | |
| 5,366,773 | A | | 11/1994 | Schroll et al. | |
| 5,413,662 | A | | 5/1995 | Skinner, III | |
| 5,435,954 | A | * | 7/1995 | Wold | 264/115 |
| 5,439,735 | A | | 8/1995 | Jamison | |
| 5,468,539 | A | | 11/1995 | Crivelli | |
| 5,474,721 | A | | 12/1995 | Stevens | |
| 5,479,751 | A | | 1/1996 | White | |
| 5,523,328 | A | | 6/1996 | Rosenbaum et al. | |
| 5,525,399 | A | | 6/1996 | Kiser | |
| 5,527,409 | A | | 6/1996 | Lanphier | |
| 5,551,353 | A | * | 9/1996 | Fiedler | 108/51.3 |
| 5,641,553 | A | | 6/1997 | Tingley | |
| 5,653,923 | A | | 8/1997 | Spoo et al. | |
| 5,660,209 | A | | 8/1997 | Franz et al. | |
| 5,662,761 | A | | 9/1997 | Middelman et al. | |
| 5,687,652 | A | * | 11/1997 | Ruma | 108/57.25 |
| 5,693,413 | A | | 12/1997 | Hesterman et al. | |
| 5,700,495 | A | | 12/1997 | Kemerer et al. | |
| 5,704,178 | A | | 1/1998 | Ciao | |
| 5,709,933 | A | * | 1/1998 | Evans | 428/297.4 |
| 5,714,219 | A | | 2/1998 | Mashunkashey et al. | |
| 5,723,192 | A | | 3/1998 | Jonasz | |
| 5,728,338 | A | | 3/1998 | Kiser | |
| 5,733,943 | A | | 3/1998 | Doan | |
| 5,783,125 | A | | 7/1998 | Bastone et al. | |
| 5,789,477 | A | | 8/1998 | Nosker et al. | |
| 5,800,754 | A | | 9/1998 | Woods | |
| 5,833,796 | A | | 11/1998 | Matich | |
| 5,852,077 | A | | 12/1998 | Zawada et al. | |
| 5,879,495 | A | * | 3/1999 | Evans | 156/82 |
| 5,908,265 | A | | 6/1999 | Mostkoff | |
| 5,914,172 | A | | 6/1999 | Kiser | |
| 5,948,827 | A | | 9/1999 | Lupo et al. | |
| 5,960,721 | A | | 10/1999 | Huetteman et al. | |
| 6,031,009 | A | | 2/2000 | Gonzalez | |
| 6,080,342 | A | | 6/2000 | Monchiero | |
| 6,139,945 | A | | 10/2000 | Krejchi et al. | |
| 6,171,680 | B1 | * | 1/2001 | Fahmy | 428/138 |
| 6,207,729 | B1 | | 3/2001 | Medoff et al. | |
| 6,214,960 | B1 | * | 4/2001 | Marissal et al. | 108/57.25 |
| 6,216,608 | B1 | * | 4/2001 | Woods et al. | 108/57.25 |
| 6,374,753 | B1 | | 4/2002 | Radke, Jr. | |
| 6,467,118 | B2 | * | 10/2002 | Dumlao et al. | 52/783.1 |
| 6,605,343 | B1 | | 8/2003 | Motoi et al. | |
| 6,605,650 | B1 | | 8/2003 | Roth | |
| 6,655,299 | B2 | * | 12/2003 | Preisler et al. | 108/51.3 |
| 6,706,381 | B2 | | 3/2004 | Balaba et al. | |
| 6,727,290 | B2 | | 4/2004 | Roth | |
| 6,758,148 | B2 | * | 7/2004 | Torrey et al. | 108/51.11 |
| 6,962,115 | B2 | * | 11/2005 | Markling et al. | 108/57.25 |
| 6,972,144 | B2 | | 12/2005 | Roth et al. | |
| 7,013,814 | B2 | * | 3/2006 | Modesitt et al. | 108/51.3 |
| 2002/0086597 | A1 | | 7/2002 | Preisler et al. | |
| 2002/0088379 | A1 | | 7/2002 | Phillips et al. | |
| 2002/0093117 | A1 | | 7/2002 | Winget et al. | |
| 2003/0079658 | A1 | * | 5/2003 | Torrey et al. | 108/51.3 |
| 2003/0183133 | A1 | * | 10/2003 | Dehennau et al. | 108/57.25 |
| 2003/0198775 | A1 | | 10/2003 | Roth et al. | |
| 2004/0003762 | A1 | * | 1/2004 | Meyer et al. | 108/57.25 |
| 2004/0112261 | A1 | * | 6/2004 | Moore et al. | 108/57.25 |
| 2005/0145143 | A1 | * | 7/2005 | Moore et al. | 108/51.3 |
| 2005/0193926 | A1 | * | 9/2005 | Cassidy et al. | 108/51.3 |
| 2006/0236903 | A1 | * | 10/2006 | Moore, Jr. | 108/57.25 |
| 2007/0113759 | A1 | | 5/2007 | Roth et al. | |
| 2007/0137531 | A1 | * | 6/2007 | Muirhead | 108/51.3 |

FOREIGN PATENT DOCUMENTS

| | | | |
|---|---|---|---|
| DE | 1 061 507 | | 7/1959 |
| DE | 41 21 081 | A1 | 1/1993 |
| GB | 990361 | | 4/1965 |
| GB | 1 512 084 | | 5/1978 |
| JP | 53-121894 | | 10/1978 |
| JP | 2-113932 | | 4/1990 |
| JP | 4-284242 | | 10/1992 |
| JP | 5-138797 | | 6/1993 |
| JP | 9-118337 | | 5/1997 |
| WO | WO 98/25744 | | 6/1998 |
| WO | WO 00/50233 | A1 | 8/2000 |
| WO | 03/035495 | | 5/2003 |
| WO | WO 03/089238 | | 10/2003 |

OTHER PUBLICATIONS

Hunter Paine Enterprises, LLC, "Hunter Paine and Savi Combine Technologies to Create the Leading Edge RFID 'Smart' Pallet" (Mar. 2004).

* cited by examiner

COMPOSITE STRUCTURAL MATERIAL AND METHOD OF MAKING THE SAME

RELATED APPLICATIONS

This is a U.S. national stage application filed under 35 U.S.C. §371 based on International Patent Application No. PCT/US2005/047194, having an international filing date of Dec. 29, 2005, which claims the benefit of U.S. Provisional Patent Application No. 60/639,804, filed Dec. 29, 2004.

BACKGROUND OF THE INVENTION

There are many different structural materials, made at least in part from synthetic resins, that are intended to be used in place of wood. An elusive goal in designing such materials is the combination of reasonable cost with relatively high strength and stiffness. Thus, for example, synthetic lumber made by hot-melt extrusion of mixtures of waste wood fiber and recycled thermoplastic material such as polyethylene can be produced at a low enough cost to make them feasible for use as decking boards. Such synthetic lumber is generally considered unsuitable, however, for uses that require it to withstand higher bending and compression loads, require increased static strength and stiffness requirements, and/or require greater shock and impact resistance. Thus, it is generally unsuitable for use as primary structural load-bearing elements, such as posts, joists, beams, and stringers for shipping pallets. For those types of uses a material has to have a higher flexural modulus of rupture, izod impact resistance, ultimate compressive strength, Young's modulus, and/or accelerating weight resistance than are found in the hot-melt extrudates of polymer and wood particles.

SUMMARY OF THE INVENTION

The composite structural material of the present invention comprises a dimensionally-stable core that is surrounded, at least in part, by dimensionally-stable laminar covering that is adherent to the core. The core can be comprised of any dimensionally-stable solid, and preferably is comprised of a resinous matrix in which pieces of one or more filler solids are embedded. The laminar covering is comprised of at least one reinforcing layer bonded to at least one layer of a dimensionally-stable web material.

DETAILED DESCRIPTION OF THE PREFERRED EMBODIMENTS

A. Composite Structural Material

Figure 1:
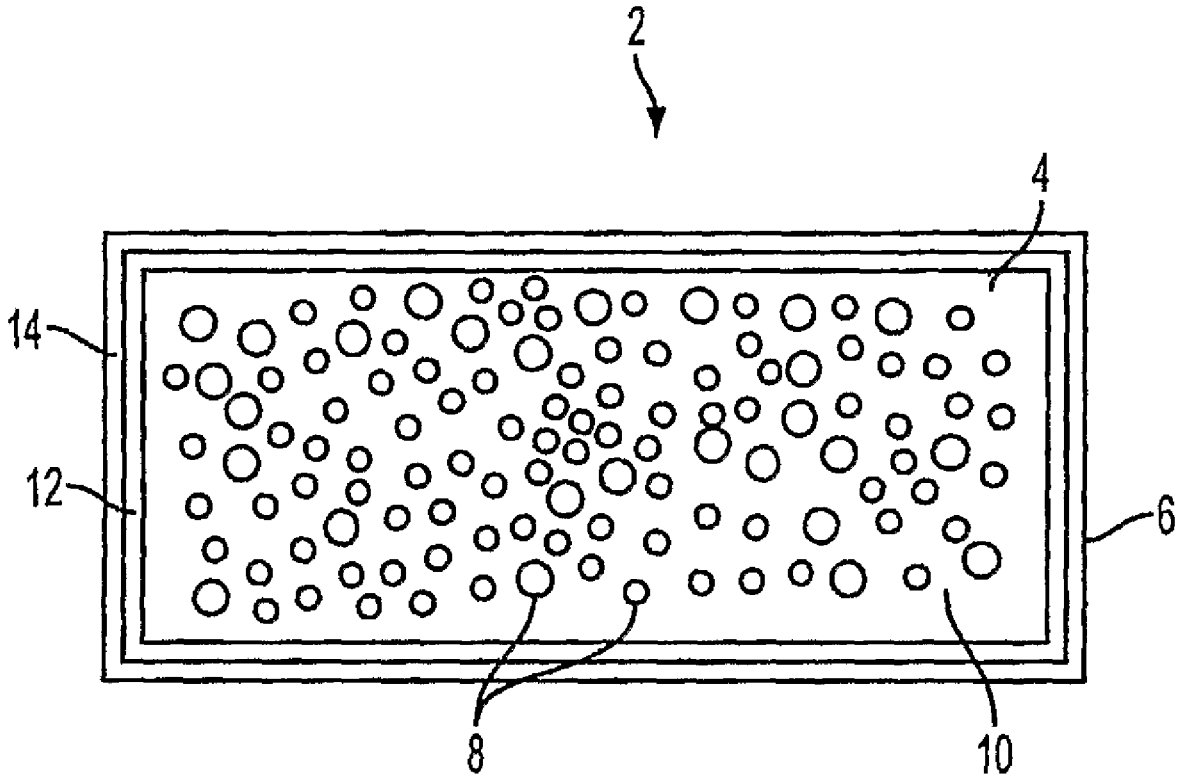
FIG. 1 is a cross-sectional view of a preferred embodiment of a board-shaped composite of the present invention, wherein the cross section is taken perpendicularly to the longitudinal direction of the composite.

As illustrated by the cross-sectional view in FIG. 1, the composite structural material 2 comprises a dimensionally-stable core 4 that is surrounded, at least in part, by a dimensionally-stable laminar covering 6 that is adherent to the core.

1. Core

The core can comprise any dimensionally-stable solid. Rigid as well as semi-rigid solids can be used. (By "rigid" is meant herein at least substantially rigid.) As examples of rigid solids, wood itself can be used as the core material, as can gypsum and Portland cement compositions, e.g., cement that is mixed (diluted) with cellulose fiber. In the semi-rigid category are elastomers, e.g., natural or synthetic rubber. Preferably the core has sufficient crush resistance that it will transfer a load (stress) on one surface of the composite to the opposite surface thereof. For example, if the top surface is put under a compressive load, the bottom surface will be placed under tension, due to the core's resistance to crushing.

Whether rigid or semi-rigid, the core is preferably comprised of a resin. For some applications, the core 4 preferably is comprised of pieces of a filler solid 8 embedded in a resinous matrix 10, such as shown in FIG. 1. (The term "resinous matrix," as used herein, is intended to embrace both filled and unfilled resins.)

a. Resinous Matrix

When the core comprises a resinous matrix, preferably it is a thermosetting resin. Examples of suitable thermosetting resins include epoxy resins, urea-formaldehyde resins, melamine-formaldehyde resins, phenol-formaldehyde resins, polyester resins, and polyurethane resins (both polyether-polyurethanes and polyester-polyurethanes). Alternatively, the resinous matrix can be a foamed thermoplastic resin, e.g., expanded polystyrene.

When it is important that the structural material have as low a specific gravity as is reasonably possible, it is preferred that the resinous matrix be a foamed synthetic resin, most preferably a rigid or semi-rigid polyurethane or phenolic foam. Polyurethane resins are made by reacting polyols with polyisocyanates. The reaction is exothermic. Cross-linking, or branching, of the polyurethane molecules can be achieved by including in the reaction mixture some polyol molecules and/ or isocyanate molecules that have at least three functional groups, and by adjusting the ratio of reactants accordingly. With sufficient cross-linking, rigid or semi-rigid thermoset polymers are obtained. The degree of rigidity can be controlled, for example, by the choice of polyol that is used, which is well known in the art.

To make rigid or semi-rigid polyurethane foam, a mixture is made of a polyfunctional isocyanate, a polyol, a blowing agent, a catalyst, and, usually, a cell-size regulator (e.g., a surfactant). A urethane-forming reaction begins once the ingredients are combined. Ali exotherm forms, and the blowing agent or agents cause closed cells to form in the polymer as the mass expands and solidifies. The exotherm typically reaches a peak temperature of at least about 150° F. The isocyanate and polyol reactants include enough molecules with three or more functional groups that the degree of cross-linking or branching is sufficient to produce at least a semi-rigid foam.

Aromatic polyisocyanates often are used when making rigid or semi-rigid foam. Some examples are toluene diisocyanate (TDI) and polymeric isocyanate (PMDI), which is obtained by the condensation of aniline with formaldehyde.

Polyols that can be used include polyether polyols and polyester polyols. Propylene oxide adducts of polyfunctional hydroxy compounds or amines are one type of polyether polyol that can be used. Mixtures of polyester polyols and polyether polyols sometimes are employed.

Halogenated hydrocarbons, such as hydrochlorofluorocarbons and hydrofluorocarbons, can be used as blowing agents. Lower alkanes such as butanes, pentanes, and cyclopentanes can be used as well. Liquid carbon dioxide can be used. Water can also be used, as it will react with isocyanate to generate carbon dioxide in situ. Sometimes water or carbodiimide catalysts are used to generate carbon dioxide as a co-blowing agent. Often the blowing agent or agents are preblended with the polyol, together with the catalyst and the cell-size regulator, which usually is a surfactant.

All of this is well known to persons of ordinary skill in the art and is described, for example, in Kirk-Othmer Encyclopedia of Chemical Technology, 4th Ed. (1997), vol. 24, pp. 695-715, which is incorporated herein by reference.

The term "polyurethane system" can be used to refer to a particular combination of isocyanate, polyol, catalyst, blowing agent, and cell size regulator that is capable of reacting to form a polyurethane foam. A characteristic that helps identify and distinguish polyurethane systems is the density of the foam a particular system will create when the components are mixed in an open vessel (the "free rise density"). It is thought that polyurethane systems capable of yielding a free rise density of about 3 or 4 pounds per cubic foot (pcf) to about 50 to 60 pcf are generally preferred for use in the present invention.

Polyurethane systems can be molded to higher densities by restricting the free rise of the polyurethane in a closed or partially closed mold. When the rise is restricted in a mold, the resultant polyurethane has a higher density (the "molded density") than the rated free rise density for the polyurethane system.

In pallets comprised of stringers, leading-edge boards and interior deck boards made of the composite structural material of the present invention, the stringers preferably use a polyurethane system that yields a molded density of about 32 to 34 pcf. The interior deck boards preferably use a polyurethane system that yields a molded density of about 12 to 17 pcf. And the leading-edge boards preferably use a polyurethane system that yields a molded density of about 14 to 20 pcf.

Examples of some commercial isocyanate/polyol pairings that can be employed in forming polyurethane systems for use in the present invention are the following:

| Isocyanate Component | Polyol Component | Rated Free Rise Density |
|---|---|---|
| Rubinate M | Rimline WL 87380 | 8-9 pcf |
| Rubinate M | Rimline WL 87381 | 15-18 pcf |
| Baydur 645 B | Baydur 645 A | 5 pcf |
| Baydur 730 B (U 731 B) | Baydur 649 A | 9 pcf |
| Copps B-1000 | Copps A-1000 | 14-17 pcf |
| Copps B-1000 | Copps A-1001 | 32-34 pcf |

In the above table, the Rubinate and Rimline reactants are available from Huntsman Chemicals, the Baydur reactants are available from Bayer Corporation, and the B-1000, A-1000, and A-1001 reactants are available from Copps Industries, Inc.

Phenolic foams can be made, for example, from resole resins, e.g., phenol-formaldehyde resins made from a molar excess of formaldehyde. The preparation of such a foam is disclosed, for example, in U.S. Pat. No. 5,653,923, which is incorporated herein by reference.

b. Filler

The filler solid, when used, preferably comprises pieces of one or more of the following: lignocellulosic material, cellulosic material, vitreous material, cementitious material, carbonaceous material, plastic, rubber, and sand. Although these are preferred examples, the filler solid can be virtually anything, including even ground-up pieces of recycled composite boards made in accordance with the present invention.

Preferably, the pieces of filler solid are homogeneously distributed throughout the resinous matrix, and substantially the entire surface of each filler particle is in contact with, or "wetted" by, the resin, such that direct filler-to-filler contact is minimized or generally avoided. Preferably, there is at least about 70-percent wetting, meaning that at least about 70 percent of the total surface area of all the filler particles is wetted. More preferably, at least about 90 to 100-percent wetting is achieved.

The filler particles can be of any shape, e.g., fibrous, flake, or granular (including spherical, e.g., silicate spherules and hollow polymeric spherules, including polymeric microspheres).

As regards the size of the pieces of filler used in the core, preferably their longest dimension will be no more than about 50 percent of the thickness of the composite structural material. Thus, for example, if the composite structural material is a board having a thickness of one inch, substantially all of the pieces of filler solid preferably will have a longest dimension that is no more than about ½ inch.

Preferably the nature of the matrix resin, the nature and amount of the filler particles (if any), and the degree of foaming (if any) of the matrix resin will all be chosen so that the core material has a crush resistance of at least about 200 pounds per square inch (psi) or more, e.g., in the range of about 200 to 2500 psi. (This refers to the amount of pressure required to reduce the core material's thickness by ten percent.) If the matrix resin is foamed, such crush resistance can be measured, for example, by ASTM D 1621-94, entitled "Compressive Properties of Rigid Cellular Plastics."

The crush resistance of a rigid solid is generally directly related to its density, and so is also related to the ability of the material to hold a nail. (The denser the rigid solid, the more able it generally is to hold a nail.) The present invention is particularly useful for providing wooden-board-substitutes for shipping pallets. For the deck boards of shipping pallets, which do not have to hold nails, and for which the lowest feasible specific gravity is often desired (to lighten the load), a crush resistance as low as about 200 psi (with its concomitant low density) can generally be used, although a crush resistance of at least about 1100 psi is preferred. For stringers in shipping pallets, which generally do have to hold nails, generally the crush resistance should be at least about 1800 psi, and most preferably at least about 2200 psi.

For many applications it will be preferred that the composition and amounts of the matrix resin and filler particles (if any) be such that the structural material has a coefficient of linear thermal expansion that is less than about $3.0\times10^{-5}$ inch per ° F., more preferably less than about $0.3\times10^{-5}$ inch per ° F.

i. Cellulosic and Lignocellulosic Fillers

Suitable lignocellulosic materials include wood, e.g., wood powder, wood flake, and waste wood fiber, as well as fiber from woody plants. Suitable cellulosic materials include, for example, plant material such as bamboo, palm fiber, bagasse, rice straw, rice hulls, wheat straw chaff, hemp, sisal, corncobs, and seed shells, e.g., walnut shells. If lignocellulosic or cellulosic material is used, preferably it is fibrous.

ii. Vitreous Fillers

Suitable vitreous materials include glass (including volcanic glass), fly ash, and ceramic particles. Vitreous spheres can be used, e.g., glass or ceramic microspheres, the weight majority of which have a diameter of about 5 to 225 microns. To lighten the weight, such microspheres can be hollow. Specific examples include Z-Light® ceramic microspheres, which are available from 3M Company and which have a bulk density of approximately 0.7 g/cc and a crush strength of about 2,000 to 3,500 psi. These come in different versions. One version that it is believed may be especially suitable is Z-Light W-1020 microspheres, the weight majority of which have diameters in the range of about 10 to 120 microns and a crush strength of approximately 3,500 psi.

Among the various hollow glass microspheres that can be used are Scotchlite® Glass Bubbles, also from 3M Company, e.g., Scotchlite 538, which has a bulk density of about 0.38 g/cc, a crush strength of about 4,000 psi, and particle sizes that mostly (as measured by weight, not the number of microspheres) fall in the range of about 8 to 88 microns.

Where a filler having a relatively high specific gravity can be used, as, for example, where a savings in the cost of raw materials is a greater priority than keeping down the weight of the composite, solid glass microspheres, which are relatively inexpensive, can be used.

When used, glass microspheres might constitute, for example about 2 to 90 percent of the volume of the finished material's core.

Pumice and perlite, both of which are forms of volcanic glass, are often preferred as a vitreous filler. Preferably the perlite is expanded to form a lightweight aggregate. Preferably, the average size of the pumice or expanded perlite particles is about 1 inch or less (#8 sieve). When used, pumice or expanded perlite might constitute, for example, about 10 to 80 percent of the volume of the finished material's core, more preferably about 30 to 60 percent of the core's volume.

Glass or ceramic reinforcing fibers also can be used.

iii. Cementitious Fillers

As suitable cementitious material may be mentioned, for example, Portland cement, gypsum, blast furnace cement, silica cement, and alumina cement.

iv. Carbonaceous Fillers

As suitable carbonaceous material may be mentioned, for example, carbon black and graphite, as well as carbon fibers.

v. Plastic Fillers

As regards plastic materials, both thermoset and thermoplastic resins can be used. As suitable plastics may be mentioned, for example, addition polymers (e.g., polymers of ethylenically unsaturated monomers), polyesters, polyurethanes, aramid resins, acetal resins, phenol-formaldehyde resins, melamine-formaldehyde resins, and urea-formaldehyde resins. Homopolymers and copolymers can be used. Suitable copolymers include interpolymers, graft copolymers, and block copolymers.

As examples of suitable addition polymers may be mentioned polyolefins, polystyrene, and vinyl polymers. Suitable polyolefins include, for example, those prepared from olefin monomers having two to ten carbon atoms, e.g., ethylene, propylene, butylene, and dicyclopentadiene. Poly(vinyl chloride) and acrylonitrile polymers can be used. Particles of waste plastic, e.g., post-consumer waste plastic such as used plastic bags and containers, can be used. Examples include bottles made of high density polyethylene and polyethylene grocery store bags.

As suitable polyesters may be mentioned polymers formed by condensation reaction of one or more polycarboxylic acids with one or more polyhydric compounds, e.g., an alkylene glycol or a polyether alcohol. Polyethylene terephthalate is an example of a suitable polyester resin. Chopped up, used polyester containers are a source of such filler particles.

Suitable plastics also include synthetic fibers—e.g., reclaimed fibers from discarded carpet, such as nylon, polyolefin, or polyester carpet fibers.

Suitable polyurethanes include, for example, polyether polyurethanes and polyester polyurethanes.

Among the various plastic fillers that can be used in the core are expandable polymer beads. By "beads" we here mean particles of any geometry, e.g., spherical, cylindrical, or lumpy. Expandable polymer beads are cellular pellets of expandable polymer that often are used to form lightweight molded objects. Created in a more or less granular form, and with an expanding agent in the cells, typically the beads are pre-foamed, or "pre-expanded," by heating to a temperature above their softening point, which often will be in the range of about 165 to 185° F., until they foam to give a loose aggregate of the desired bulk density. The pre-foamed particles, which retain their cellular structure, may then be placed in a mold or other cavity and heated with live steam, causing them to sinter and fuse together to form a lightweight, cellular solid whose dimensions correspond to those of the mold cavity. When fully expanded, the beads often will have a diameter that is about two to four times that of the unexpanded, or "raw," beads.

Depending upon the manner in which the rigid core is made, the beads can possibly be heated to such a high temperature that they will sinter while enclosed in the resinous matrix of the core. If so, at least a substantial portion of the beads will then lose their cellular structure, creating gas-filled pockets, of various sizes, in the foam, which are lined with the polymer of which the cellular structure was formed. It appears that isolated spherical beads generate relatively spherical pockets. These hard, polymeric globules can lower the density of the core without significantly lowering its crush resistance. Indeed, it appears that they may even enhance the crush resistance.

The source of the heat necessary to cause bead sintering can be an exothermic reaction that generates the matrix resin in which the beads are trapped. Thus, for example, the matrix resin can be formed by blending the necessary reactants to generate an exotherm having a peak temperature in the range of about 185 to 285° F.

Chief among expandable polymer beads are expandable polystyrene (EPS) beads and expandable polyolefin (EPO) beads.

Methods of making expandable polystyrene beads are well known. As disclosed in U.S. Pat. Nos. 3,991,020; 4,287,258; 4,369,227; 5,110,835; 5,115,066; and 5,985,943, for example, all of which are incorporated herein by reference, EPS beads may be made by polymerizing styrene in an aqueous suspension, in the presence of one or more expanding agents that are fed at the beginning, during, or at the end of polymerization. Alternatively, they may be made by adding an expanding agent to an aqueous suspension of finely subdivided particles of polystyrene.

The expanding agent, also called a "blowing agent," is a gas or liquid that does not dissolve the styrene polymer and which boils below the softening point of the polymer. Examples of suitable blowing agents include lower alkanes and halogenated lower alkanes, e.g., propane, butane, pentane, cyclopentane, hexane, cyclohexane, dichlorodifluoromethane, and trifluorochloromethane. Often the beads contain about 3 to 15 percent, based on the weight of the polymer, of the blowing agent. Preferably, the blowing agent will be present at a level of about 3 to 7 percent.

By "polystyrene" is here meant a styrene homopolymer or copolymer containing 50 weight percent or more, preferably at least 80 weight percent, of styrene. Examples of suitable comonomers are α-methylstyrene, ring-halogenated styrenes, ring-alkylated styrenes, acrylonitrile, esters of acrylic or methacrylic acid with alcohols having from 1 to 8 carbon atoms, N-vinylcarbazole, and maleic acid or anhydride. A minor amount of a copolymerized chain-branching agent may be included in the polymer as well. Suitable such agents are compounds containing at least two α,β-ethylenically unsaturated groups, such as divinyl benzene, butadiene, and butanediol diacrylate. Branching agents are generally used in an amount of about 0.005 to 0.05 mol percent, based on the styrene.

The polystyrene in the EPS beads usually has a weight average molecular weight in the range of about 130,000 to about 300,000.

EPS beads come in different unexpanded particle sizes. Generally, a bead's longest dimension (e.g., its diameter), on a weight average basis, will be in the range of about 0.1 to 6 mm, often about 0.4 to 3 mm. It is thought that unexpanded particle sizes in the range of about 0.4 to 1.6 mm are preferred for the beads used in the present invention.

Unexpanded polymer beads vary as to their expansion capability, i.e., how large they can get when heated to expansion temperature. In part, this is a function of how much blowing agent they contain. The expansion capability of a polymer bead can be reported in terms of the bulk density of the loose aggregate the beads will form when they are fully expanded ("fully expanded density"). By "fully expanded" it is here meant the expansion that results from the "two pass" expansion process described in Example 2 of U.S. Pat. No. 5,115,066. This entails the use of a Tri Manufacturing Model 502 expander (or equivalent), operated at an inlet steam temperature of about 211° F. and an inlet steam flow rate of approximately 74 pounds per hour. The first-pass throughput rate is about 208 pounds per hour. A fluidized bed drier, blowing ambient air, is used to cool the resulting prepuff. After aging for 3 hours at ambient temperature and humidity, the prepuff is run through the expander again, under the same conditions, except operating at a throughput rate of about 217 pounds per hour.

It is thought that the use of EPS beads having a capability of reaching a fully expanded density in the range of about 0.5 to 4.5 pcf, e.g., about 1 to 3 pcf, is preferred in the present invention. Examples of some commercial EPS beads that can be used in the present invention are Types 3371, 5371, and 7371 from Huntsman Chemical and Types BFL 322, BFL 422, BF 322, BF 422, and P 240 from BASF Corporation.

As examples of expandable polyolefin beads may be mentioned expandable polyethylene (EPE), expandable polypropylene (EPP), expandable polybutylene (EPB), and copolymers of ethylene, propylene, butylene, 1,3-butadiene, and other olefin monomers, particularly alpha-olefin monomers having from 5 to 18 carbon atoms, and/or cycloalkylene monomers such as cyclohexane, cyclopentene, cyclohexadiene, and norbornene. Propylene/ethylene copolymers and propylene/butylene copolymers may be preferred.

Methods of making expandable polyolefin beads are disclosed, for example, in U.S. Pat. Nos. 6,020,388; 5,496,864; 5,468,781; 5,459,169; 5,071,883; 4,769,393; and 4,675,939, all of which are incorporated herein by reference.

Expandable polymer beads may contain other additives to impart specific properties either to the beads or to the expanded products. These include, for example, flameproofing agents, fireproofing agents, nucleating agents, decomposable organic dyes, lubricants, fillers, and anti-agglomerating additives. As disclosed in U.S. Pat. No. 6,271,272, incorporated herein by reference, the beads may also include additives, e.g., certain petroleum waxes, that quicken the rate of expansion when the beads are heated to expansion temperature. Depending on the intended effect, the additives may be homogeneously dispersed in the beads or present as a surface coating.

If expandable polymer beads are used as filler solids in making the core material for the present invention, they can be mixed with the matrix resin precursor mixture in either the unexpanded, partially expanded, or substantially fully expanded state. Preferably, however, by the time the matrix resin has set, the polymer beads will have undergone at least a partial expansion, as well as a sintering, to yield the polymeric globules entrapped in the matrix. This is described in greater detail in U.S. Pat. No. 6,727,290, issued to Arthur J. Roth, one of the present inventors. This patent is incorporated herein by reference.

vi. Rubber Fillers

Pieces of natural or synthetic rubber can be used as a filler solid also, e.g., rubber made of styrene-butadiene resin, polybutadiene, or polyisoprene. A preferred source of rubber is used and scrap tires, which can be pneumatic tires or non-pneumatic tires.

Older tires are preferred because they generally have fewer volatives and are less elastomeric. Truck tires are preferred over passenger tires, because they have greater rigidity, although both passenger and commercial tire crumb rubber are acceptable for use in the present invention. Preferably, any metal in the tires from metal belts amounts to no more than about 3 weight percent of the rubber, most preferably one percent or less, especially if the composite structure material is to be used to construct shipping pallets. There are a number of reasons. The more metal content, the greater the pallet weight, which increases shipping costs. Also, the presence of pieces of metal can cause additional wear and tear on the equipment used to make the composite structural material, e.g., augers, extruders, and injection heads. Also, if allowed to remain in or among the tire fragments used as filler solids, metal cords, shards, or splinters can project through the laminar covering when the composite is under compression and damage the load on the pallet or present a safety hazard to material-handling personnel.

Ground-up used tire rubber is available commercially and comes in different particle sizes. Perhaps preferred for the present invention is rubber having a longest dimension of about ¼ inch or less, preferably with the tire cord (referred to as "fluff") not removed. Both black and white tire crumb can be used.

When used, granulated tire rubber might constitute, for example, about 10 to 90 percent of the volume of the finished material's core.

Scrap tire rubber is a relatively inexpensive filler, on a volume basis. It is rather heavy, however, and if it is important that the specific gravity of the composite structural material be at or below a certain value, the amount of tire rubber that can be used may be limited accordingly. Thus, for example, if the composite structural material is to be used as synthetic boards to fabricate shipping pallets, specific gravity (i.e., finished pallet weight) may be a concern. If so, the rubber content perhaps should comprise no more than about 60 percent of the core's volume.

If, on the other hand, the structural material is to be used for an application that is less demanding in terms of specific gravity, e.g., as for range fencing, stationary decking, or highway guard rail posts or blocks, such composites can have much higher specific gravities. This often permits the use of rubber concentrations of up to 80 to 90 percent of the core's volume.

2. Laminar Covering

The laminar covering 6 is comprised of at least one reinforcing layer 12, such as a band of substantially parallel reinforcing cords and/or a fibrous mat, bonded to at least one layer of a dimensionally-stable web material 14. Because the laminar covering is dimensionally stable, it functions rather like an exoskeleton in the composite structural material of the present invention.

The laminar covering 6 can surround the core 4 completely, as shown in FIG. 1, or can be provided one fewer than all sides of the core. In the sheet-like composite shown in FIG. 2, for example, the laminar covering 6 is only provided on opposite sides of the core 4.

Figure 3:
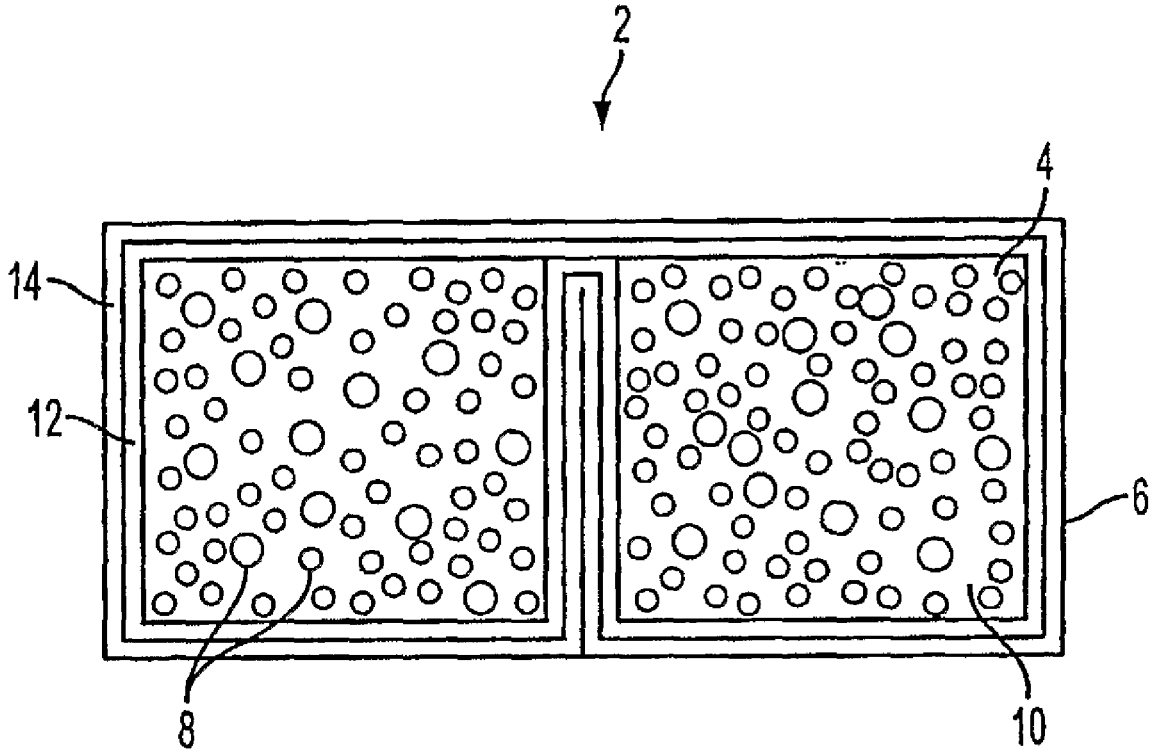
FIG. 3 is a cross-sectional view of another preferred embodiment of a board-shaped composite of the present invention, wherein the cross section is taken perpendicularly to the longitudinal direction of the composite.

The laminar covering 6 can also be folded upon itself, such as shown in FIG. 3. In this embodiment, the laminar covering functions rather like an I-beam, permitting the use of a less dense material in the core 4.

Figure 14:
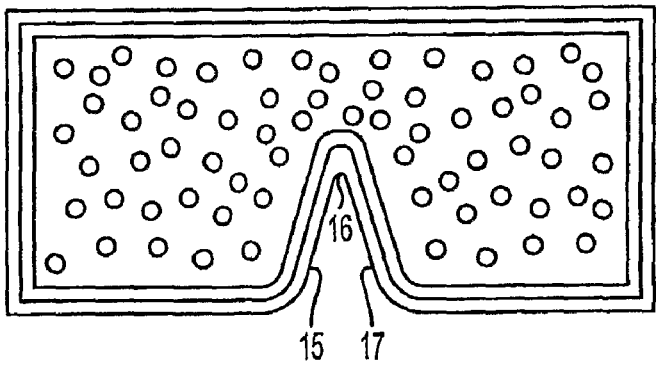
FIG. 14 is a cross-sectional view of an alternative embodiment of a board-shaped composite of the present invention, wherein the cross section is taken perpendicularly to the longitudinal direction of the composite.

Alternatively, as shown in FIG. 14, a lengthwise indentation (defined by walls 15, 16, and 17) can be formed in the composite.

The structures of FIGS. 3 and 14 are believed to be especially useful when the composite is to be used as a flooring board. In each embodiment, when the composite has a uniform, non-square, rectangular cross-section throughout its length, one of the wide sides of the structural material has a lengthwise indentation of the web material, such that, in said rib, there are opposing wall segments of the indented web material. Because the web material is stiff, this strengthens the structural material. Preferably the indentation rib intrudes into the structural material a distance that is at least about one-third the thickness of the structural material, most preferably at least one-half the thickness. The opposing wall segments of the indented web material can either be flat against one another, as shown in FIG. 3, or be angled toward one another, in the direction toward the inside of the structural material, as shown in FIG. 14. If the segments are flat against one another, preferably they are bonded together.

Figure 2:
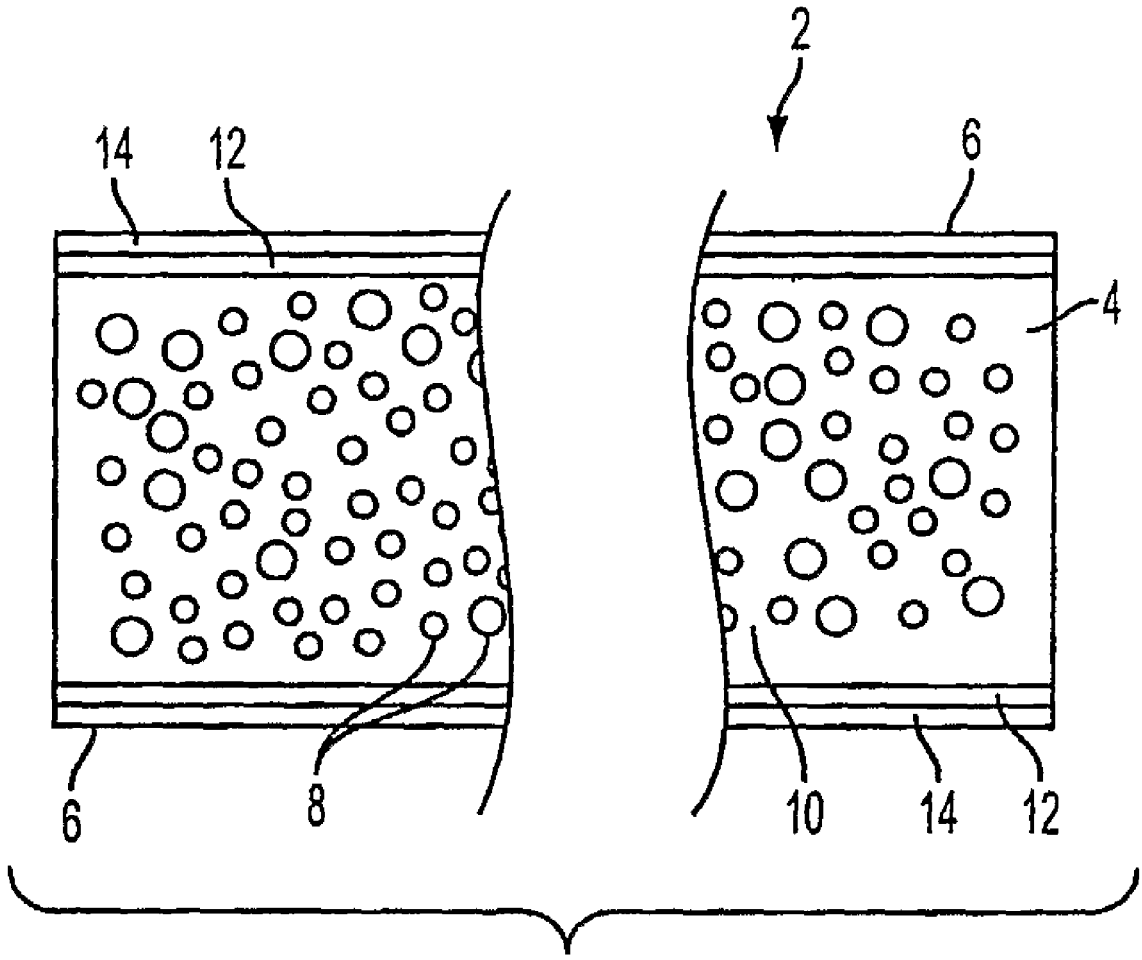
FIG. 2 is a cross-sectional view of a preferred embodiment of a sheet-like composite of the present invention, wherein the cross-section is taken perpendicularly to the plane of the composite.

The laminar covering can be comprised of a single layer of web material located exterior to a single reinforcing layer, as shown in each of FIGS. 1-3. Alternatively, a plurality of layers of one or both can be used. Preferably, the covering will comprise at least one combination of a reinforcing layer bonded to a web layer that is exterior to the reinforcing layer. Particularly preferred combinations include the following, wherein $P_i$ represents an innermost paper layer (next to the core), $P_m$ represents an inner-ply paper layer, $P_p$ represents an outermost paper layer (furthest from the core), and RL represents a reinforcing layer:

$P_i$-RL-$P_o$

RL-$P_m$-RL-$P_o$ $P_i$-RL-RL-$P_o$ $P_i$-RL-$P_m$-RL-$P_o$ $P_i$-RL-RL-$P_m$-$P_o$ $P_i$-RL-$P_m$-RL-$P_m$-$P_o$

The properties of the composite will vary depending upon its aspect ratios, i.e., the ratio in a particular cross-sectional direction of the thickness of the composite's laminar covering (or facia), Tf, to the composite's total thickness, T. Thus, for example, a composite in the shape of a 1×4 inch board that is surrounded with a ⅛ inch thick facia will have a thickness aspect of 0.25 (Tf=2×⅛ inch=¼ inch; T=1 inch) and a width aspect of 0.062 (Tf=2×⅛ inch=¼ inch; T=4 inches). Generally it is preferred that, in at least one cross-sectional direction, the composite have an aspect of at least 0.1.

Facia of different thicknesses can be used on different sides of the composite, even on opposite sides. Thus, for example, where the composite is a board that will be subjected to minimal lateral loads but extensive vertical loads, one might save expense by using thinner facia on the sides than on the top and bottom. In a situation in which the board will be subjected to strenuous vibrations, it may be desirable to use a thicker wall on the top than on the bottom.

Greater surface smoothness generally can be obtained if the outermost of all the reinforcing and web layers is a web layer. This can be advantageous in a case in which the structural material has to be kept sanitary. If, for example, the structural material is to be used as a board in a shipping pallet (e.g., as either a stringer or a deck board), it might have to be sterilized when the pallet is used in areas of food preparation or handling. This can entail steam treatment and/or washing with disinfectants containing bactericides, such as chlorine-containing reagents. The composite structural material of the present invention, especially when having a resin-stiffened web material at its outer surface, can be easier to sanitize than boards of real wood, due to its having fewer cracks, crevices, and pores in which microorganisms can reside, and possibly escape the heat or contact with the disinfectant.

a. Web Material

The web material in the laminar covering preferably is rigidified paper or rigidified cloth.

Examples of suitable cloths for use as the web material include both woven and nonwoven fabrics, made of natural or synthetic fibers, which can be metallic or non-metallic. Thus, for example, fabrics such as woven metallic cloth and fiberglass cloth can be used. Mixtures of various fibers can be used as well.

Because it is less expensive than cloth, paper is generally preferred. When paper is used, preferably it will have a thickness in the range of about 10 to 30 mils. The paper can be a web of various fibers, e.g., one or more types selected from the group consisting of cellulosic, glass, carbon, metal, and synthetic resin. Examples of suitable synthetic resin fibers include polyamide fibers and polyester fibers. Most preferably the fibers are oriented in the paper, e.g., as in paper in which the fibers are oriented in the machine or warp direction, also sometimes called the "milled direction."

For reasons of economy it is believed to be preferable to use a paper that is made at least primarily of cellulosic fibers, e.g., from wood pulp. A preferred cellulosic paper is kraft linerboard paper, for example having a basis weight (or "grade code") of at least about 20 lbs per msf (thousand square feet), more preferably about 40 to 100 lbs.

Generally it is preferred that the paper contain at least about 20 percent recycled material, by weight—most preferably at least about 30 percent thereof. One suitable paper is 100-percent recycled standard linerboard paper having a basis weight of about 69 lbs. Such is manufactured, for example, by Gaylord Container Corporation. Another suitable paper is 25-percent recycled kraft linerboard having a basis weight of about 90 lbs. Such can be obtained, for example, from Longview Fibre Company, of Longview, Wash., under Specification No. 5204. Still another suitable paper is 33-percent recycled kraft linerboard having a basis weight of about 42 lbs. Virgin paper also can be used, of course, but it tends to have lower capillarity than recycled paper, which, for that reason, is generally preferred.

When foamed polyurethane is used as the core matrix resin, it is generally preferred that the adjacent rigidified paper or cloth have a moisture content of about 5 wt. % or less, at the time the composite is being made. If a higher moisture content exists in the paper or cloth, the polyurethane-precursor chemicals can tend to react with the moisture and create more foaming at the interface of the core and the web material than occurs in the interior of the core. This can result in a stratum of relatively low density foam adjacent the web material. When this occurs, the bond between the core and the web material can become fragile.

Certain papers are relatively highly water-absorbent and, if kept in a relatively humid atmosphere, can absorb sufficient moisture from the air to result in a water content above 5 wt. %. To adjust for this, in the process of the present invention the web material can be conveyed through a dehumidification zone prior to depositing thereon the polyurethane-resin precursor mixture. Any kind of dehumidification zone can be used, including a drying oven, e.g., a convection oven. If a convection oven is used, it might be at a temperature of, say, 250 to 500° F. Preferably the dehumidification of the web material occurs before any application of the binding/stiffening resin to the material. Preferably the web material will exit the dehumidification zone at a moisture content of about 4% or less, e.g., in the range of about 1 to 4 wt. %.

To prevent or minimize the migration of binder through the outer web and onto the outer surface of the laminate, the outer surface may be coated or pre-impregnated with a non-porous, synthetic resin (e.g., polypropylene) to reduce or eliminate the build-up of resinous binder on manufacturing-equipment surfaces. The resin can be applied either in liquid form or as a pre-formed, self-supporting film. When such a resin is used, preferably it will have a film thickness in the range of about 1 to 5 mils, most preferably about 2 to 3 mils. The resin can be colored, to help beautify or identify the finished composite, thereby eliminating or minimizing the amount of post-production coloring required to market the composite or articles manufactured from it. If, instead, no resin coating is used and one attempts to color the composite by using a colored web material as the outermost layer when manufacturing the composite, then the stiffening resin, especially if it is an epoxy resin, can adversely affect the color. If the resin is applied as a pre-formed film, the film can be pre-printed with any desired design or text to either decorate or identify the finished composite.

As already suggested, and as will be explained later herein in more detail, it is preferred that a resin be used to bond the reinforcing layer to the web material and to impregnate and stiffen the web material. In such an embodiment it can be useful if the outermost ply of web material (e.g., paper) includes a barrier layer to prevent the resin from bleeding through the web material. The barrier layer may be comprised, for example, of a resin, e.g., poly(vinyl alcohol), which can be an effective barrier to the migration of an epoxy or polyester resin through the thickness of the web material. By use of this feature, if the outermost ply of web material has a core-facing layer that is resin-permeable and a layer external to that that bars resin migration, the resin, while stiffening the web material, will not bleed to the outer surface of the composite.

If desired, after the composite is removed from the mold, the outer layer of the bifurcated paper can be coated (e.g., sprayed) with an external surface treatment, to impart desired physical and/or chemical properties to the outer surface of the composite. An example of such a multi-layered paper is Specification No. 6228 from Longview Fibre Company.

Another option is to concentrate a fireproofing agent in the outer layer of a barrier-layer-containing paper, where the agent will be most effective. This is best done if the paper comprises two external porous layers (one of each side) and a barrier layer sandwiched between the two.

In some instances, however, it may be preferable to allow the resin to completely permeate the outermost ply of web material, as this may eliminate the need for an external surface treatment or finish. For example, if the outermost paper layer has a relatively low basis weight, e.g., less than about 50 lbs, then the resin that is used to bond the reinforcing layer to the paper usually will be able to completely permeate the outermost paper layer. If the paper is colored and/or preprinted with a water-based decorative pattern or logo, then, obviously, there would be no need to adorn the finished material.

b. Reinforcing Layer

As noted above, the reinforcing layer can comprise, for example, a band of substantially parallel reinforcing cords and/or a fibrous mat.

When cording is used and the composite is elongated, it will often be preferred that the cording be aligned in the long direction. Alternatively, the cording can run perpendicularly or diagonally to the composite's long direction. For example, if the elongated composite has a round cross section, the cording can be wound spirally around the core, preferably surrounding the core with a uniform layer of cording. When a spiral-wound composite is intended to be used as, for instance, a post to support a highway guard rail, a suitable covering may consist of two plies of paper with one ply of polyester cording, in the form of a scrim, sandwiched between the two plies of paper. For sheet-like materials that are just as likely to be stressed from any of several different directions, it may be advantageous to include one or more reinforcing layers having randomly-oriented fibers or parallel cords running in multiple directions.

Preferably the cording used in the laminar covering has a tensile strength in the range of about 5 to 18 lbs per cord, most preferably about 16 lbs. The cording preferably has a breaking tenacity of about 0.67 to 1.10 gf/TEX, most preferably about 0.85 gf/TEX.

The cording can be made of continuous filament or staple fibers. Monofilament cording can be used, but cording made of a plurality of continuous filaments (so-called "multifilament" cording) is preferred. Preferred multifilament cording is that which is made of about 40 to 70 filaments. If multifilament cording is used, the filaments can be twisted or untwisted. If twisted, it is preferred that the cord have not more than 3.25 twists per inch.

As for breaking elongation, preferably the cording's is in the range of about 10 to 50 percent, e.g., about 20 or 25 percent to about 45 or 50 percent. Most preferred for monofilament cording is a breaking elongation of about 30 to 40 percent, e.g., about 35 percent. Most preferred for multifilament cording is a breaking elongation of about 15 to 20 percent, e.g., about 17 percent.

The cording can be made in whole or in part of either natural or synthetic fibers or filaments, including fibers/filaments of synthetic resin, glass, carbon, or metal. Synthetic resin fibers/filaments are often preferred, e.g., polyester, polyamide (such as nylon and poly-paraphenylene terephthalamide), or polyolefin fibers or filaments. Glass fibers/filaments generally provide greater stiffness in the composite structural material. For certain uses, e.g., fence boards, a better ability to bend might be preferred; in that situation polyester fiber/filaments generally work better than fiberglass.

If the cording is made of shrinkable fibers/filament, preferably it is heat stabilized prior to being used to construct the composite structural material of the present invention.

When made of a monofilament, the cording preferably has a diameter of about 8 to 15 mil (i.e., about 0.008 to 0.015 inch), most preferably about 10 to 12 mil. When made of multifilament, the cording preferably has a denier of about 600 to 1,000, most preferably about 900.

As for the density of the parallel cords in the band—i.e., the number of cords per inch of width of the band—the preferred level varies in inverse relationship to the diameter or denier of the cording; the thicker the cording, the lower the preferred density. Generally, the density will preferably be at least about 5 cords per inch of band width ("lateral inch"), and usually not more than about 35 cords per lateral inch. More preferably, there are about 8 to 14 cords per lateral inch.

The parallel reinforcing cords can be unconnected to one another, or they can be laterally connected, e.g., by cross-cording or a common substrate such as a mat. Laterally-connected cords are more easily held in place during the formation of the laminar covering.

One way of providing the cords in a connected fashion is to use a strip of cloth in which the longitudinal cords constitute the warp, i.e., the "yarn," "fiber," or "thread" that is in the cloth's "machine direction." The cloth may be, for example, a woven cloth or a cross-laid scrim. The latter is a nonwoven netting formed by laying parallel rows of continuous yarn or thread in the warp direction and then laying parallel rows of cross yarns or threads on top of that layer, at a 90 degree angle thereto, and bonding the two layers together at the cord intersections, e.g., either by thermal bonding or by use of a glue. When cross-laid scrim is used, the warp side can either face outwardly from the composite or inwardly. Preferably, however, it will face outwardly and will be next to a layer of web material.

Generally it is preferred that any cloth that is used have a warp direction tensile strength that is within the range of approximately 90 to 200 pounds per lateral inch (pli), most preferably approximately 155 to 185 pli. By this is meant the amount of longitudinal stress necessary to tear apart a one-inch-wide band of the cloth, running in the warp direction.

If the cloth comprises any shrinkable fibers/filament, preferably those will be heat stabilized before the cloth is used to construct the composite of the present invention.

When cross-cording is used and a higher modus of elasticity in the machine direction is desired, it is preferred that the cross-cording (i.e., the woof or weft of the cloth, also sometimes called the "pic" or the "fill") be of a smaller diameter and/or of a lesser density (fewer cords per inch of cloth) than the warp. Thus, for example, the diameter or denier of the warp cords may be about 1.8 to 2.5 times that of the woof cords, and the density of the warp cords (i.e., the number of cords per lateral inch of the cloth) may be about 1.5 to 3 times the density of the woof cords (i.e., the number of cords per longitudinal inch of the cloth.)

When woven cloth made of 10 to 12 mil monofilament in the warp direction is used, preferably the warp density will be at least about 20 cords per lateral inch of the cloth, e.g., in the range of about 20 to 35 cords per lateral inch of the cloth. The woof cords of such a cloth preferably will have a diameter in the range of about 4 to 8 mil, most preferably about 6 to 8 mil. The woof density for such a cloth may be, for example, about 10 to 18 cords per longitudinal inch of cloth.

Among the woven cloths that can be used very effectively to supply the reinforcing cords are those composed of about 8 to 12 mil polyester monofilament as the warp and about 6 to 8 mil polyester monofilament as the woof. Advantageously such polyester cloth has approximately 20 to 30 cords per inch in the warp and approximately 10 to 15 cords per inch in the woof. Prototype fabric No. XF368080 from Industrial Fabrics Corporation, of Minneapolis, Minn., is a woven polyester cloth that meets these specifications. Its warp cording has a diameter of approximately 10 mil, a tensile strength of approximately 5.2 lbs per cord, and a breaking elongation of approximately 46 percent. The density of the warp is approximately 27 to 29 cords per lateral inch. The woof cording has a diameter of about 8 mil. It is estimated that a one-inch-wide strip of this cloth has a tensile strength in the warp direction of approximately 95 to 105 lbs and an elongation at break of approximately 46 percent.

Also suitable is the same woven polyester cloth as just described, but having a warp cord density of only 24 cords per lateral inch. It also can be obtained from Industrial Fabrics Corporation. That fabric has a warp direction tensile strength of approximately 91 pli and an elongation at break of approximately 46 percent.

An example of a suitable cross-laid scrim is Connect™ scrim from Conwed Plastics, Inc., of Minneapolis, Minn. One embodiment thereof has a warp composed of untwisted polyester multifilament cord (60 filaments per cord) having a denier of about 1000. The warp has a cord density of 12 cords per lateral inch. The warp cording has a tensile strength of about 17.5 lbs per strand of the cord. A one-inch-wide, warp direction strip of the scrim has a tensile strength of about 185 lbs, a breaking elongation of about 24 percent, and a breaking tenacity of about 0.92 gf/TEX.

Another example of a suitable reinforcing layer is a product available from Scrimco, Inc., of Fresno, Calif., under the designation 1812P2/0.9GA. This product comprises a nonwoven fiberglass mat having affixed thereto glass rovings (1,800 yards per pound) and polyester yarn (1,000 denier). The mat, which consists of randomly-oriented glass fibers, weighs 0.9 lbs per 100 square feet. The glass rovings and polyester yarn run in the warp direction, and are adhered to only one side of the mat, using polyvinyl alcohol. Per lateral inch, there are about 12 glass rovings and about 2 strands of polyester yarn. The product, including the mat and cords, weighs about 42.7 pounds per thousand square feet, and has a tensile strength of at least about 300 pli.

Alternatively, the same glass rovings and/or polyester yarn used in the 1812P2/0.9GA product could be used without the fiberglass mat. To keep the cords in place during the manufacturing process, they could be adhered directly to one or both sides of the web material.

Still another option is to use the 1812P2/0.9GA fiberglass mat without any cords. Such an embodiment will not provide as much tensile strength as will a board including the glass rovings and polyester yarn, but may nonetheless prove useful for certain low-load applications.

Preferably the laminar covering will comprise a band of parallel cords (which, as indicated, can be a strip of cloth, cords adhered to a mat or the like, or cords alone) that covers at least one side of the structural material. For example, at least about 25 percent of the cross-sectional circumference of the material can be covered with one or more bands of parallel cords. If the material is rectangular in cross section, it is most preferred that at least two opposite sides be covered with bands of the cords. Most preferably, all sides of the structural material will be covered with bands of the cords. If the cross section is an elongated rectangle and the material is to be used as deck boards for shipping pallets, e.g., as a substitute for 1×4 inch or 1×6 inch lumber, it is preferred that at least the two wide sides of the board be covered with bands of the cords.

For other uses, however, if only two sides are covered with the bands of cords, it might be preferred that they be the narrower sides. Thus, for example, in shipping pallets the stringers often are wooden 2×4 s or 3×4 s set "on edge." If the structural material of the present invention is to be used in place of such wooden boards, then it is preferred that at least the two narrow sides be covered with bands of the cords.

Most preferred for shipping pallets, however, is that all four sides of both the deck boards and the stringers be reinforced with bands of parallel cords. In this way not only is the pallet able to withstand large loads, it also is more resistant to damage along the vertical surfaces of the boards, e.g., due to being hit by fork lift tines.

Where all sides of a board-shaped composite are to be covered with bands of cords, the four bands need not always be constructed the same. Thus, for example, one pair of opposite sides might require bands of lower tensile strength than the other two sides.

If the cording is being supplied by a scrim or adhered to a mat, and it is desired to use different cord bands (e.g., having different tensile strengths) or more or fewer cords on different sides of the structural material, one can use a multi-zone scrim or mat that is wide enough to wrap around the core of the board. If it is a four-zone scrim or mat, each zone will be the width of (and will register with) one of the four sides of the board. Different warp cords and/or different cord densities can be used in the four different zones, while the cords and cord densities in the woof direction (if any) are kept uniform.

As far as dimensions are concerned, the present invention is very useful for the construction of board-shaped composites or sheet-like composites having a thickness of about ½ inch to 8 inches and a width of about 2 to 60 inches and columnar composites having a diameter in the range of about 2 to 18 inches, although it certainly is not limited to such materials. The length of such composites can vary from several inches to upwards of 50 feet, if desired.

Optionally, the reinforcing cords in the laminar covering can be bonded to the web material in a pretensioned state. However, pretensioning is not required, as long as there is sufficient tension to keep the reinforcing layer taut during the manufacturing process. The amount of tension, if any, can be expressed in terms of how much the cord is stretched. Thus, every cord has an elongation-at-break value that is expressed as how much, in percent, the cord's length can be increased by stretching, before the cord breaks. The more it is stretched, the greater the tension on the cord. In the present invention it is contemplated that it generally will be preferred that the cord not be stretched (i.e., elongated) beyond about 85 percent of its capacity. Thus, if its elongation at break is 30 percent, say, then it is preferred that the cord not be lengthened by tension to more than 125.5 percent of its starting length.

If the cords are pretensioned, it is preferred that each cord be stretched to at least about 10 percent of its capacity, most preferably at least about 20 percent, 30 percent, or 40 percent of its capacity. Often the most preferred range will be about 50 or 60 percent to about 80 percent of its capacity. Generally it will be preferred, when cloth is used as the source of the parallel cords, that it be pretensioned in the warp direction to a value of at least about 10 pli, most preferably at least about 50 pli, e.g., at least about 75 or 100 pli.

c. Binding and Stiffening Resin

The reinforcing layer preferably is bonded to the web material by a resin, most preferably a resin selected from the group consisting of epoxy, polyurethane, acrylic, nitrile, butyl, allyl, urea-melamine, vinyl ester, phenolic, silicone, and cyanoacrylate resins. A thermosetting resin, e.g., a thermosetting vinyl ester resin or a thermosetting epoxy resin, is most preferred. If the core comprises a matrix resin, then the bonding resin preferably is compatible with the matrix resin, i.e., will adhere thereto. In this regard, certain polyurethane and epoxy resins are known to be compatible, as are certain phenolic and vinyl ester resins.

To make the laminar covering dimensionally stable, it is preferred that the web material be impregnated with a set resin, most preferably a cured thermosetting resin. Again, compatibility with any bonding resin and matrix resin that is used is desired. Preferably the same binding resin that is used to bond the reinforcing layer to the web material is also used to impregnate and stiffen the web material.

Alternatively, two or more different but compatible resins could be used to impregnate and bind different layers of the laminar covering to each other, to the core, and/or to a surface layer exterior to the laminar covering. For example, the innermost layer of web material could be impregnated with a resin that binds particularly well to the core material, while the outermost layer of web material could be impregnated with a resin that binds well to a metallic foil surface layer, for example, or that imparts desired surface characteristics to the finished composite (e.g., UV resistant, flame retardant, specific coefficient of friction). Such properties may be inherent in the resin itself or imparted to the resin through the addition of known additives, such as, for example, hardening agents, toughening agents, dyes or pigments, and the like.

Preferably, the extent of the permeation by the resin(s) into each layer of web material is 100 percent, although complete permeation is not absolutely required. Often, the innermost layer of the laminar covering will be permeated by a combination of the resin in the laminar covering and that used in the core.

Optionally, the binding/stiffening resin can include one or more particulate-solid filler materials. Particularly useful are hollow microspheres, e.g., made out of glass, ceramic material, polymeric material, or mineral material, creating, in effect, a "bubble binder." When the plies of the laminar covering are pressed together while the binding-resin mixture is still wet, the filler particles tend to concentrate in the spaces between the parallel cords. While this somewhat decreases the durability of the final exoskeleton, that sacrifice is offset by a savings in the amount of binder resin that is required. By using hollow spheres as the filler, the weight of the product is minimized. When filler is used in the binding-resin mixture, it is preferred that at least 50 vol. % of the filler have a particle size of 125 microns or less. Most preferred are microspheres having a specific gravity of less than about 0.5 g/cc. Generally, the greater the area that exists between adjacent cords in the parallel-cord layer, the higher the concentration of filler that can be used in the binding-resin mixture. Often the filler will occupy at least about 10 or 25 percent of the volume of the mixture of binding resin and filler.

Epoxy resins are perhaps preferred for the stiffening resin and the bonding resin. Both one-component epoxy resin systems that require elevated temperatures to cure and two-component epoxy resin systems that can cure at room temperature can be used. The two-component systems have separate resin and hardener components.

As for viscosity, the systems can be thin enough to be sprayable or so viscous that they have to be applied with, for example, a bath roller or a "pin" roller. An example of the sprayable type is R 88-14B/H 88-14E from Copps Industries, hic., which is a two-component system having a viscosity (immediately after mixing) of about 1,480 cP, when mixed at a weight ratio of 4.2 parts resin to one part hardener. Its gel time at 77° F. is approximately 24 minutes, as measured by ASTM D 2471. An example of a system that also can be used, but which is too viscous to be sprayed effectively, is R 88-14A/H-14D, also available from Copps, which is a two-component system having a viscosity of about 3,000 cP, when mixed at a weight ratio of 3.1 parts resin to one part hardener, and a gel time at 77° F. of about 42 minutes.

The R 88-14B/H 88-14E system is designed to bind laminated structures and will bind well to cellulosic paper, fiberglass mesh, polyurethane foam, and recycled rubber, among other materials. R 88-14A/H 88-14D also is designed to bond to a wide variety of similar and dissimilar materials.

Another suitable thermosetting epoxy resin system is A-900/B-900, also available from Copps. This two-component system has a viscosity (immediately after mixing) of less than about 5,000 cP, e.g., about 2,900 to 3,300 cP, as measured by ASTM D 2196, when mixed at a ratio of approximately 4.4 parts resin to one part hardener, by weight, or approximately 4.2 parts resin to one part hardener, by volume. The gel time for 100 g of the mixed epoxy resin at 77° F. is at least about one minute, e.g., about 6 to 10 minutes, as measured by ASTM D 2471. When allowed to cure overnight at 77° F., plus four hours at 150° F. and two hours at 212° F., the epoxy has a tensile strength of at least about 3,000 psi, e.g., about 4,500 to 5,500 psi, and a tensile modulus of at least about 100,000 psi, e.g., about 200,000 to 350,000 psi, as measured by ASTM D 638; a compressive strength of at least about 5,000 psi, e.g., about 8,000 to 9,000 psi, as measured by ASTM D 695; and a flexural strength of at least about 7,000 psi, e.g., about 8,500 to 11,000 psi, as measured by ASTM D 790.

3. External Surface Treatment

The outer surface of the laminar covering may optionally be provided with an external surface treatment that is tailored to the intended use of the composite.

For example, the outermost coating on a composite that is to be used as a highway guardrail post can contain a chemical that repels climbing plants such as ivy.

Another chemical additive that can optionally be included in the laminar covering is a fire or flame retardant. Similarly, reflective particles can be embedded in the outermost coating, e.g., reflective particles of the type used in highway safety markers. Pigments and/or dyes can be included as well, for decoration or identification purposes. Also, an anti-corrosion chemical can be included, as, for example, when it is anticipated that the composite might come into contact with a chemical that could otherwise react with, and degrade, the laminar covering. Thus, for example, a board-like composite that is to be used to construct pallets for the shipping of drums containing a particular corrosive chemical can contain in its outermost coating a component that confers resistance to that chemical, in case of leakage.

For some purposes it may be important that the outermost surface on one or more sides of a composite have a coefficient of friction that is within certain defined limits. Thus, for example, the top surface of deck boards on a shipping pallet should have a high enough coefficient of friction that load shifting will not be a problem during transit, but not so high a coefficient that it is unacceptably difficult to slide freight on or off the pallet. To help set the desired co-efficient of friction, the outermost coating on the laminar covering can have friction-increasing asperities projecting from the surface. Such asperities can be provided by use of the same techniques as are used to make pickup-truck bedliner surfaces slip resistant, e.g., by embedding a grit material such as sand in the coating, by forming the polymeric coating in such a way that it is non-smooth, or by stippling the surface with droplets of a resin that leaves small bumps on the surface.

For decoration or other purposes, the outermost layer of the laminar covering can optionally be a wood veneer, e.g., having a thickness of at least about 4 mil. If the thickness is about 20 mil or more, such a veneer generally functions as a structural membrane—i.e., it adds strength to the composite. Some non-limiting examples of other materials that the composite can be coated with include metallic foil, vinyl, PVC, high density polyethylene, and commercial hot-melt extrudents, such as Trex® decking material.

4. Dissimilar Embedments

The laminar covering can optionally contain an embedment of a material that is dissimilar from the core and covering, and which has a physical property that can be measured from a distance, e.g., a property such as inductance, reflectance, thickness, density, or two-dimensional shape, which can serve as an identifying feature of the composite, or the article in which the composite is included. The material can be composed, for example, of a metal, a sulfate, a chloride, or graphite. Examples of suitable metals include aluminum, copper, gold, nickel, cadmium, zinc, bronze, chromium, cobalt, potassium, chrome, lead, tin, and silver. A metallic layer deposited on a substrate can be used, for example.

The embedment can be coterminus with the reinforcing layer and/or web material, or it can be a smaller section. The embedment's physical property can be detectable by, for example, diffraction or refraction techniques using external-source electromagnetic radiation, e.g., x-rays or radio waves. The embedment can even include a circuit, such as a radio frequency identification device (RFID), that emits a signal when contacted by an electromagnetic field.

By use of this embedment feature, the composite (or an object made therefrom, such as a shipping pallet) can be provided with a type of tagging device, e.g., to indicate the nature of one or more components of which the composite or object is made, or where and/or when it was manufactured, or by whom it is owned.

B. Methods of Making Composite Structural Materials

1. Making a Board-Like Composite Having a One-Piece Laminar Covering

Figure 4:
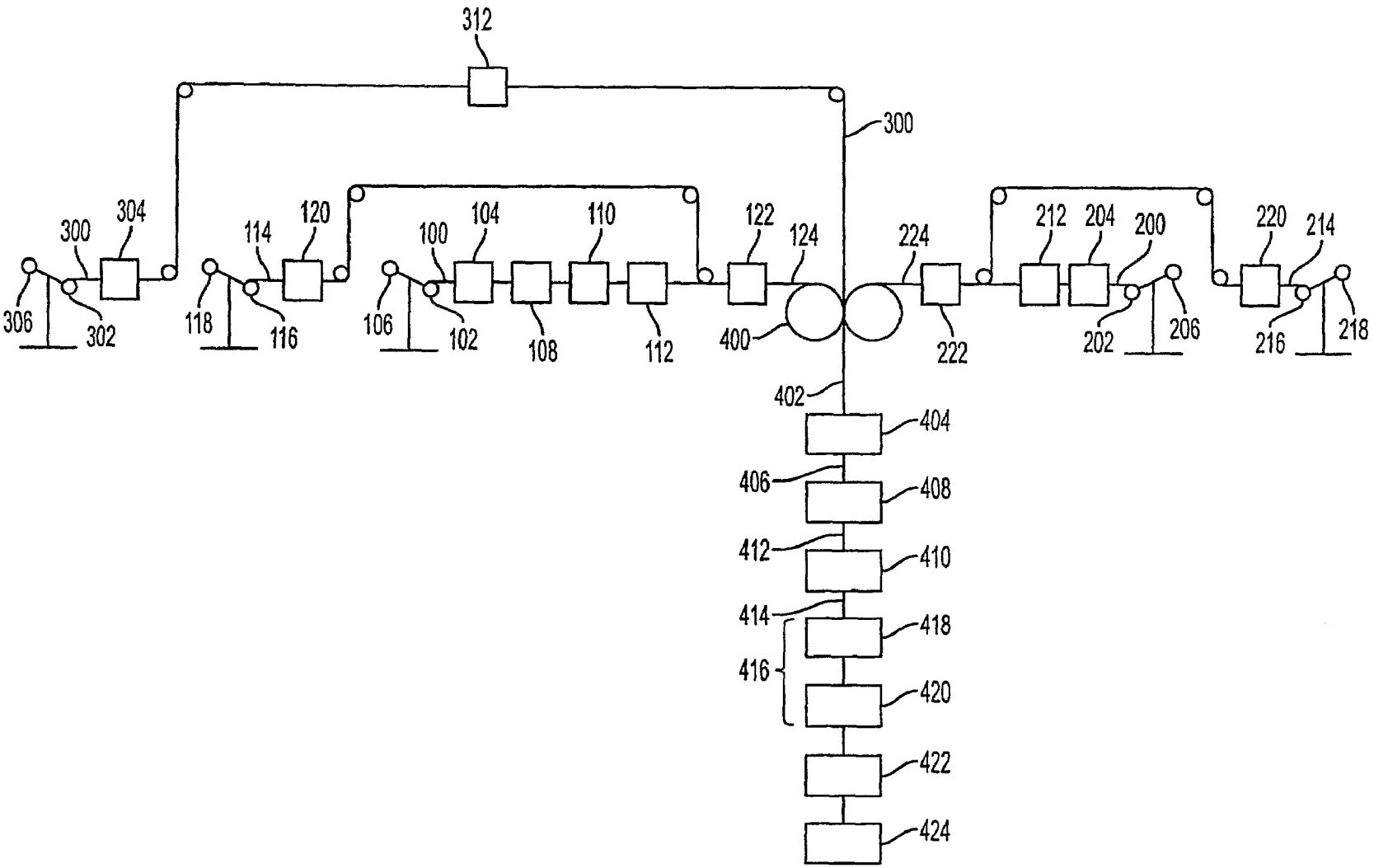
FIG. 4 is a schematic representation of a method of making a board-shaped composite of the present invention.

FIG. 4 schematically illustrates a preferred method of making a board-shaped composite having a one-piece laminar covering. Alternatively, the composite board can be made with a multi-piece laminar covering, such as disclosed in International Publication No. WO 03/089238, the disclosure of which is incorporated herein by reference.

In FIG. 4, a continuous strip of a porous web material 100, such as kraft paper, is pulled off a supply roll 102 and fed through a splicer and festoon roller assembly 104 that is configured to splice the leading edge of a reserve roll 106 of web material to the trailing edge of the primary roll 102 when the primary roll is depleted, without having to interrupt the process flow.

Optionally, a sealant coating station 108 is provided for applying a thin coating of a sealant, preferably about 0.0005 inch, to the underside of the web material 100, which will form the outermost surface of the laminar covering. The purpose of the sealant, if applied, is to prevent later-applied resins from penetrating through the outermost surface of the web material. A dryer 110 may be provided downstream of the sealant coating station 108 to dry the sealant. In some embodiments, it is preferred that the later-applied resin(s) fully permeate the outermost ply of web material, in which case the sealant coating station and dryer may be omitted.

The strip of web material 100 then passes through a web creaser 112, where it is scored with fold lines (not shown) that will form the four longitudinal edges of the finished board.

Meanwhile, a continuous strip of reinforcing layer 114 is pulled off a supply roll 116 and passed over guide rollers to a position adjacent to the web material 100. The reinforcing layer may be, for example, the Scrimco 1812P2/0.9GA product noted above. A reserve roll 118 of the reinforcing layer and a splicer and festoon roller assembly 120 can be provided to maintain a continuous supply of the reinforcing layer when the primary supply roll 116 is depleted.

The strips of web material and reinforcing layer should be wide enough to completely ensheath the core, preferably with some overlap. For example, if making a four-sided board that is 2 inches wide×3.5 inches tall, the layflat preferably is 11.5 inches wide, including a 0.5 inch overlap tab.

The creased web material 100 and the reinforcing layer 114 (collectively referred to as a "layflat" 124) then pass through a wetting station 122, which deposits a metered amount of a thermosetting resin precursor mixture (e.g., epoxy resin) onto the layflat. Preferably, the resin precursor mixture is preheated to a temperature of about 120° F. A knife-and-plate arrangement (not shown) can be utilized to spread the resin precursor mixture evenly over the surface of the layflat. Alternatively, depending on the viscosity of the resin precursor mixture, wetting might be accomplished by spraying the mixture onto the layflat, gravure printing a pattern of the mixture on the layflat, or passing the layflat through a bath of the mixture. Although FIG. 4 shows the same wetting station 122 being used to coat both the web material 100 and the reinforcing layer 114, each ply of the laminar covering can be coated separately, perhaps with different resin precursor mixtures.

While all of this is occurring, a substantially similar process (designated in FIG. 4 by corresponding 200-series reference numbers) is used to form a second resin-coated layflat 224. The materials that comprise the second layflat 224 can, but need not, be the same as those used to form the first layflat 124.

After leaving respective wetting stations 122 and 222, the layflats 124 and 224 pass downwardly between calender rollers 400, forming an unset laminate 402. The plies of web material and reinforcing layers are sufficiently porous that resin precursor mixture is forced into each ply by the calenders 400. Preferably, the gap between the calenders 400 is set at the combined thickness of the individual plies of web material and reinforcing layers. Alternatively the gap between the calendars 400 may be set to apply up to 18,000 psi of pressure to the laminate. If a pressure greater than 1,000 psi is applied, e.g., in the range of about 10,000 to 18,000 psi, it is preferred that the aforementioned microspheres be incorporated in the resin-precursor mixture.

As described, a four-ply laminar covering comprising, in order, web material, reinforcing layer, reinforcing layer, and web material, is formed. Optionally, if an intermediate layer of web material is desired, a third strip 300 can be fed to the calender rollers 400 in between the first and second layflats 124 and 224. (Components associated with the third strip of web material 300 are designated in FIG. 4 by corresponding 300-series reference numbers.) Laminar coverings with as few as two or three plies or more than five plies can be made by subtracting or adding equipment.

Optionally, after passing through the calenders 400, the flexible laminate 402 weaves its way over and under an array of festoon rollers (not shown). The space between the upper and lower gangs of festoon rollers can be set by computer so that the time required for the laminate to complete the trip through the array allows the resin precursor mixture to partially set, but not rigidify.

One reason not to use festoon rollers in certain circumstances, is that if the multi-ply laminate is bent around a roller while the laminate is impregnated with a partially set stiffening resin, adjacent plies can be forced apart, in a lateral direction, thereby weakening the bond between the plies. It is sometimes preferred, therefore, that once the multi-ply laminate reaches the stage where the stiffening resin begins to set, the laminate is not thereafter forced to bend around a roller by any substantial degree.

Whether or not festoon rollers are provided, the laminate 402 can be heated at this stage of the process to speed up the setting of the resin precursor mixture. When using an outermost layer of 42 lb kraft linerboard, an innermost layer of 90 lb kraft linerboard, two intermediate layers of the Scrimco 1812P2/0.9GA product, and the Copps A-900/B-900 epoxy resin, the inventors found that it takes approximately 100 seconds for the epoxy to set at about 210° F.; approximately 50 seconds for the epoxy to set at about 230° F.; and approximately 25 seconds for the epoxy to set at about 250° F. Accordingly, the materials used, the arrangement of the various process stations, the distances between stations, and the speed at which the line is run all factor into determining when and where in the process to apply heat to the laminate, if at all. It may also be advantageous to mechanically hold the various layers of the laminate 402 together while the resin precursor mixture is setting.

The laminate 402 next passes through a folding station 404, in which it passes over a plurality of rollers, a turning bar, and through a forming block that together progressively bend the laminate into a generally closed, but unsealed, configuration along the crease lines previously imparted by the web creasers 112, 212, and 312.

Next, the folded laminate 406 passes through a core filling station 408, in which a mixture of matrix resin precursor components and filler solids (not shown) is deposited into the core space of the folded laminate. (Prior to reaching the core filling station 408, the upper flap of the folded laminate can be propped open to allow the mixture to be deposited into the core space.) The mixture preferably consists of filler solids and a fluid mixture of the components that will react to form thermoset polyurethane foam. Known equipment such as a mezzanine-mounted, gravity-feed filler (not shown) may be used to deposit the mixture in the core space of the moving laminate. Another suitable mixer is described in U.S. Pat. No. 5,332,309, the disclosure of which is incorporated herein by reference. The amount of the mixture of matrix resin precursor composition and filler solids deposited within the core space is insufficient, without foaming, to fill the core space.

The mixture of matrix resin precursor components and filler solids can be preformed and pumped as one uniform mixture through an applicator conduit into the core space. Alternatively, the components of the mixture can be kept separate in two or more segregated streams, and those streams can be blended in a mixing nozzle, or even in the air space between the exit openings of their respective applicator conduits and the surface of the layer upon which the components land. In this way, it can be arranged that none of the material streams is independently settable; instead it requires that two or more streams be blended before a settable mixture is obtained. Thus, the method can be performed much like reaction injection molding (called "RIM" molding) in which a necessary curing catalyst and/or cross-linking agent is delivered to the fill hole of a mold cavity in one stream, while a monomer or prepolymer that needs to be mixed with the catalyst and/or cross-linking agent in order to provide a settable mixture is delivered in a separate stream. To blend the streams in the air space beyond each applicator conduit's exit opening, they can be pumped through nozzles that are aimed to cause the streams to collide in the air. Alternatively, the streams can be blended in a mixing head.

One advantage in not forming a settable mixture until all of the necessary ingredients enter or exit the applicator nozzle is that if the process has to be shut down, there will be no volume of premixed resin in a supply vessel that will have to be discarded due to its having too short a pot life.

The filler solids (if any) may be preheated to a temperature equal to or greater than the temperature of the matrix resin precursor components (e.g., at least about 180° F.) before being added thereto. This is believed to prevent or limit the occurrence of "skinning," whereby the density of the matrix resin is significantly higher immediately next to the filler particles than elsewhere in the core.

The mixture-carrying laminate 412 next is passed through a closing station 410, which may include a bead glue laminator (not shown) that applies a thin layer of a high-strength, heat-setting, fast-setting adhesive to the overlap tab and/or the underside of upper flap of the folded laminate. The upper flap is then pressed into contact with the overlap tab to seal the composite. Preferably, the total thickness of the adhesive applied to the overlap tab and/or the underside of the upper flap is about 0.03 inch.

The sealed composite 414 next is held in its closed configuration under conditions that are conducive to the setting of (i) the matrix resin in the core space, (ii) the thermosetting resin in the porous web material, and (iii) the thermosetting resin in the reinforcing layer, and for a length of time sufficient for all three resins to set to the point where the composite is stable, meaning that it will not pull apart or deform if left unrestrained. This can be accomplished, for example, by pulling the sealed composite 414 through a molding station 416 that is maintained at the proper temperature to cause the matrix resin in the core and the thermosetting resin in the laminar covering to form and set.

The molding station 416 can comprise, for example, at least one tractor mold 418, which sometimes is referred to as a type of "endless flexible belt mold." This is a type of mold in which cooperating half-mold segments revolve on opposed ovoid conveyor tracks to grip between them a section of an axially-moving, continuous, linear feed material and hold it for a time, while the material and the abutting half-mold segments continue to travel forward. The half-mold segments are connected, back and front, to identical segments, much like links in a tractor tread. Each pair cooperates to form an external die that holds its section of the feed material in the desired shape as the material solidifies. The half-mold segments can be equipped with temperature-control means to cause the synthetic resin in the feed material to become set by the time the segments reach the end of their forward run. There the opposed segments separate, releasing the section of the feed material, and each segment circles back to the beginning to grip another section of the feed material. Meanwhile, the intervening length of feed material has been gripped and treated by other pairs of half-mold segments. One example of a moving mold of this type is disclosed in U.S. Pat. No. 5,700,495, which is incorporated herein by reference. A commercially available tractor mold that might advantageously be used is ConQuip, Inc.'s tractor conveyor Model No. 844-25.

The forward run of the tractor mold preferably is long enough that, by the time the composite emerges from the mold, the impregnating resins and the matrix resin have all been formed and are set. If necessary, however, the sealed laminate can be passed through a series of two or more tractor molds or a combination of one or more tractor molds and one or more less substantial continuous-mold segments 420 in order to hold the material in the desired shape until the resins in it are all set.

The tractor mold 418 preferably is sufficiently strong to withstand an internal sleeve pressure of up to about 20 psi from the foaming matrix resin in the core, which, during this time, expands to fill the core space. The foaming can be caused by the release, expansion, or generation of one or more gases in the resin precursor mixture, e.g., a gas selected from the group consisting of carbon dioxide, nitrogen, hydrofluorocarbons (e.g., EFC 245SA and HFC 134A), chlorofluorocarbons, and lower alkanes, e.g., pentanes. Resin systems for generating foamed thermoset resins are well known in the art, and include, for example, the aforementioned polyurethane resin systems.

Preferably, the layer that contacts the matrix resin precursor composition is a layer of porous web material, preferably paper, having no resin-barrier layer. Using a web material, rather than cording, for example, as the innermost layer appears to provide for more even pressure distribution during the setting of the core's matrix resin, and, therefore, a more uniform composition of the ensheathed core material.

The tractor mold 418 can provide all of the force necessary to pull each of the porous web material and reinforcing layer strips off their respective supply rolls and through the aforementioned process stations, preferably at a constant rate of about 33 to 200 feet per minute. In addition, or alternatively, the calender rollers 400 can be used to drive the process flow.

Before and/or after the tractor mold 418, the sealed composite can pass through one or more less substantial continuous-mold segments 420, for the purpose of holding the composite in the desired rectangular shape while the resins set. Whereas the tractor mold 418 is capable of withstanding a foaming pressure of up to about 20 psi, the continuous-mold segments 420 might only need to withstand a foaming pressure of about 6 or 7 psi, for example. Therefore, the continuous mold segments 420 might be a belt-type continuous molder or a combination of idler rollers and sheet material, rather than the more elaborate tractor mold. If it is desired to apply heat to the composite while it is being carried through the continuous-mold segments 420, any suitable source thereof can be used, including, for example, radio frequency, microwave, and induction heating.

Although the continuous-mold segment 420 illustrated in FIG. 4 is shown positioned downstream of the tractor mold 418, one or more mold segments can also be located upstream of the tractor mold or both upstream and downstream of the tractor mold. In fact, it is preferred that the tractor mold be readily movable, e.g., on rails, so that it can be moved along the line to capture the composite where the foaming pressure is greatest.

After molding station 416, the resultant rigid composite passes through a cutting station 422, which cuts the composite into segments of a desired length. The resins in the composite do not have to be fully set before this cutting step; they just need to be sufficiently set that the cutting pressure will not substantially deform the composite. If further heating is desirable to complete the setting process, the cut lengths of composite can be placed in an oven, e.g., a convection oven, until they no longer are wet.

Unrestrained gas pressure in the core of the composite during the molding an resin-setting stages of the manufacturing process can cause some rupturing of the resinous bond between the core material and the laminar covering the result can be blistering on the outer surface and/or weakness of the composite. Therefore, the temperature of the laminar covering during the time when the matrix resin in the core is creaming, rising, and setting preferably is not allowed to get so high as to cause the gas pressure to reach a level where it will cause blistering or any other type of bond rupture between the core and the laminar covering.

If it is desired to remove the composition from the mold while it is still hot and before the resins have sufficiently set to restrain the internal gas pressure, gas-release holes can be pricked through the laminar covering. This can be done immediately after the hot composite exits the mold, for example by puncturing the covering with a pin wheel. Alternatively, the puncturing can be done in a last-engaging tractor mold in which puncture pins extend from the walls of the mold segments.

If desired, the composite can be coated with an external surface treatment in a coating station 424, which is preferably located downstream of the cutting station 422, but which could also be located before the cutting station. The cut ends of each board preferably are coated with a rubbery sealant.

2. Making a Sheet-Like Composite

The composite material of the present invention can also be formed as a sheet material having the laminar covering only on opposite sides of the core, as shown in FIG. 2. FIGS. 5, and 6A-6E, and 12A-12E schematically illustrate preferred methods of making such a sheet-like composite.

Figure 5:
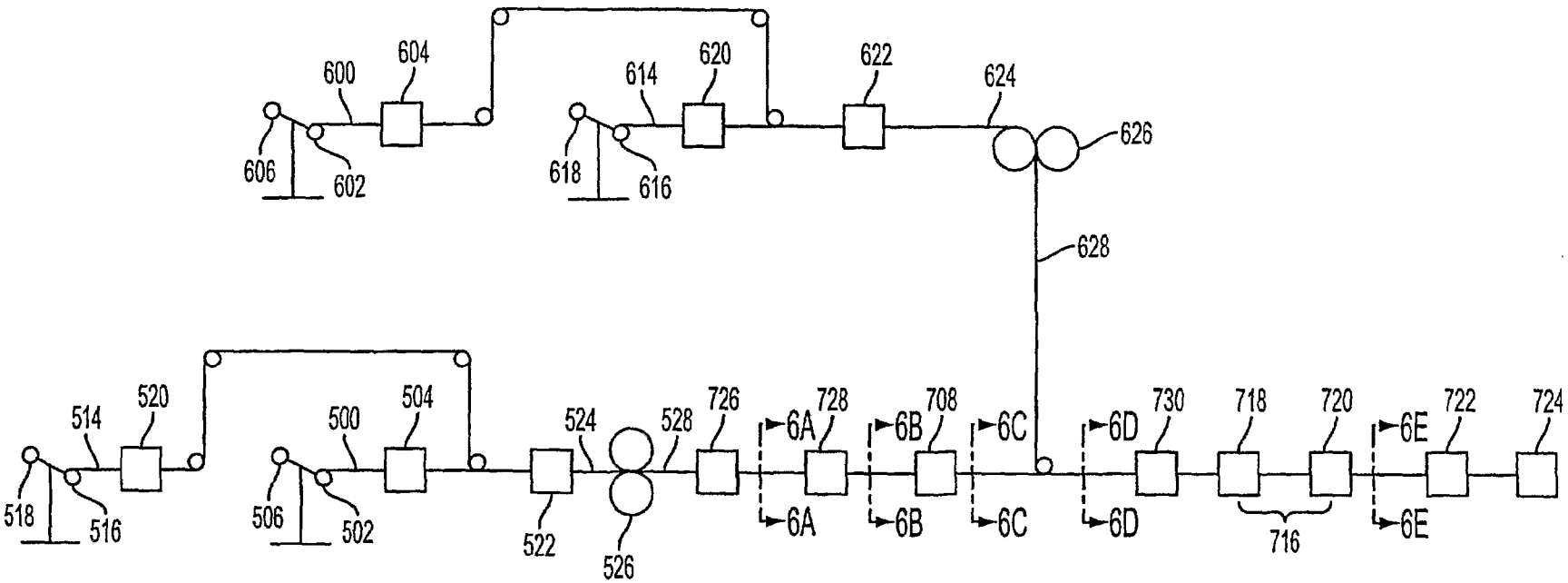
FIGS. 5 and 6A-6E are schematic representations of a method of making a sheet-like composite of the present invention.

Similar to the method described above with reference to FIG. 4, this method includes the formation of first and second layflats 524 and 624. Each layflat includes resin-impregnated strips of web material 500 and 600 and reinforcing layers 514 and 614. In FIG. 5, the components and equipment associated with the preparation of the first and second layflats 524 and 624 are represented by 500 and 600-series reference numbers that correspond to the 100-series reference numbers of FIG. 4.

Unlike the method of FIG. 4, however, in this embodiment each layflat passes through a different pair of calender rollers 526 and 626 to form lower and upper laminates 528 and 628, respectively. The lower laminate 528 passes through a taping station 726 that adheres a continuous strip of tape 732 along each edge of the laminate, as shown in the laminate cross section of FIG. 6A. Alternatively, a continuous adhesive sheet 734 can be applied to one side of the laminate, with the edges of the adhesive sheet extending beyond the edges of the laminate, as shown in the laminate cross-section of FIG. 12A.

Figure 6A:
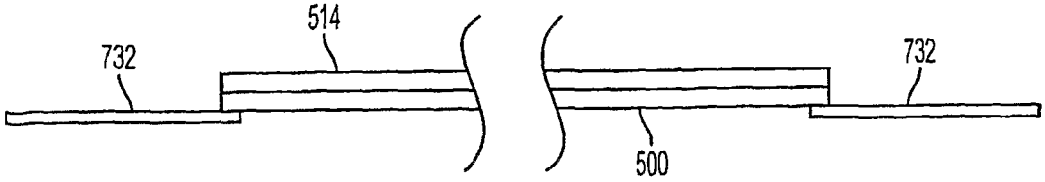
Figure 6B:
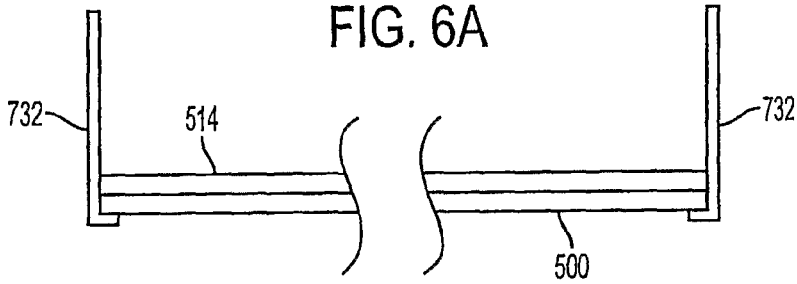
Figure 12A:
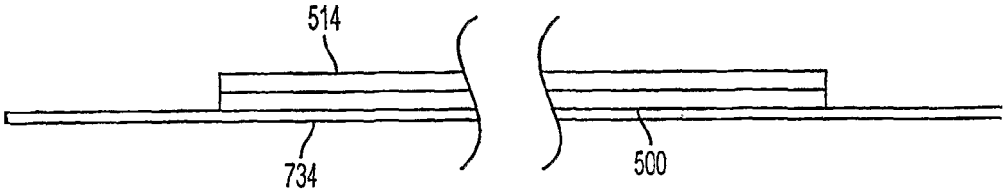
FIG. 12 is a schematic representation of an alternative method of making a sheet-like composite of the present invention.
Figure 12B:
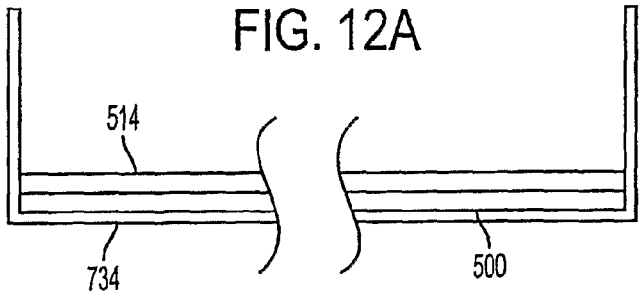

Next, tape-folding station 728 folds the tape strips 732 or the edges of the adhesive sheet 734 upward in order to form a trough on the upper surface of the laminate 528, as shown in FIGS. 6B and 12B.

Figure 6C:
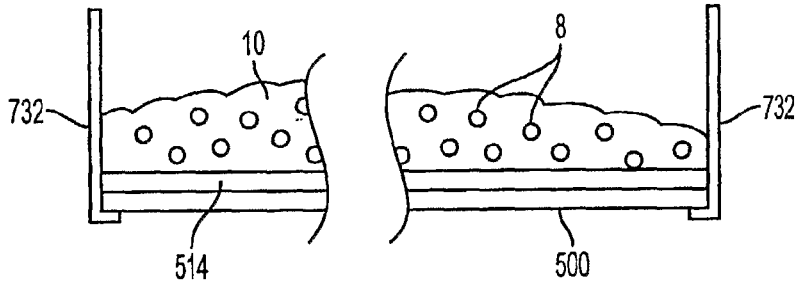
Figure 12C:
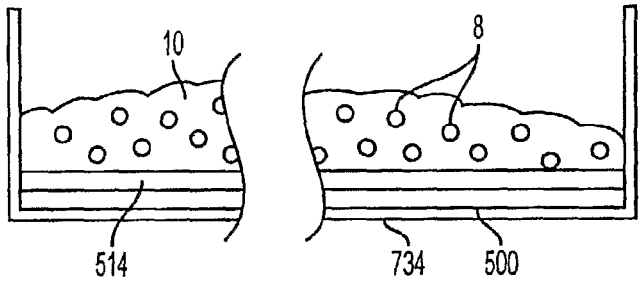

A core filling station 708, as described above with reference to FIG. 4, deposits a mixture of matrix resin precursor components 10 and filler solids 8 into the trough, as shown in FIGS. 6C and 12C. Alternatively, the filler solids may be eliminated, and the matrix-resin-precursor components 10 may be deposited directly onto the inner surface of the laminate. Generally, there is less usefulness in including a filler solid when a foamed resin of a relatively low molded density—as, for example, a polyurethane having a molded density in the range of about 7 to 8 pcf or a foamed polyethylene having a molded density in the range of about 5 to 6 pcf—is used as the matrix resin in the core.

Figure 6D:
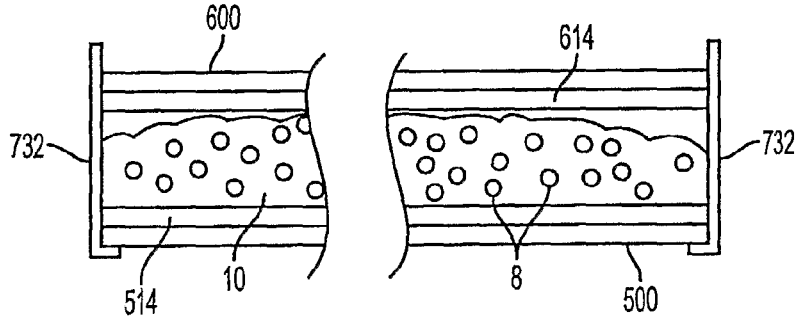
Figure 6E:
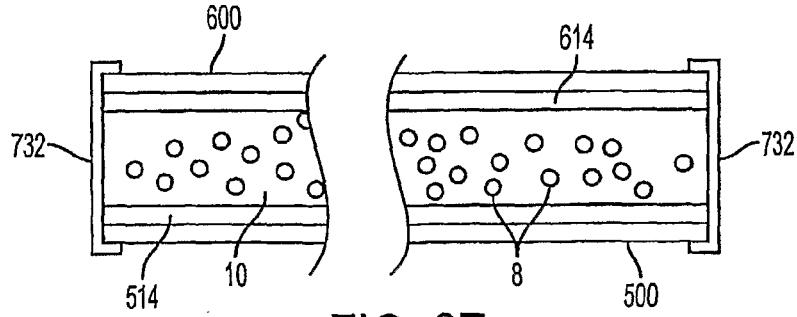
Figure 12D:
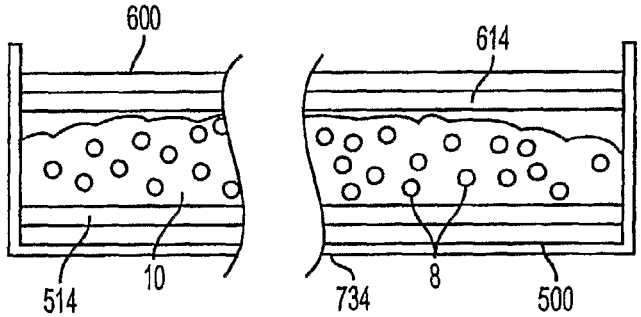
Figure 12E:
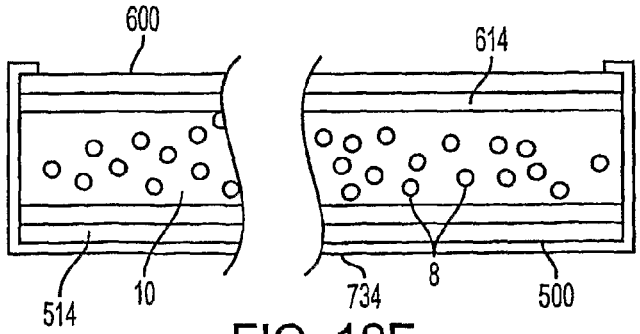

Meanwhile, the upper laminate 628, is carried to a position above the mixture-carrying laminate 528, as shown in FIGS. 6D and 12D, and the tape strips 732 or the edges of the adhesive sheet 734 are folded and adhered to the upper laminate 628 by a sealing station 730, as shown in FIGS. 6E and 12E.

Similar to the method shown in FIG. 4, the composite thereafter passes through a molding station 716, a cutting station 722, and optionally a coating station 724. The molding station 716 can comprise a tractor mold 718 and one or more continuous mold segments 720, in any order.

The sealing station 730 need not be provided before the molding station 716; rather, it could be located after the molding station or be incorporated as part of the molding station.

Sheetlike composite material made according to the present invention can be used for a variety of different applications. It can be used, for example, as shipping-container flooring, as insulating roof sheathing, as exterior construction sheathing, as insulating flooring, or as wallboard. In each of these applications it is preferred that the core matrix resin be foamed. A benefit of using a foamed resin is greater insulation value. When making wallboard, to keep the cost down, polystyrene foam often is preferred. Also, the extenial ply on one side of the wallboard preferably is bifurcated paper with an interior film that functions as a barrier to the bleeding through of the binding/stiffening resin that is used to rigidify the paper and bind it to the next ply. To keep costs down, the stiffening resin in the laminar covering of the composite, when used as wallboard, can be a polyester resin. Still the wallboard will be structural, whereas conventional gypsum wallboard is not. And if the wallboard is substantially devoid of filler, it can be lighter in weight than conventional gypsum wallboard, even though it is substantially stronger.

When using as shipping-container flooring, the sheet-like composite of the present invention can beneficially use any of the laminar coverings and resinous cores that are disclosed above in connection with making pallet stringers.

Insulating roof sheathing made of the present composite can be used on roofing joists, in place of oriented strand board. If a foamed resin core is used, like polyurethane, the sheathing will provide better insulating value than oriented-strand-board roof sheathing.

When the sheet-like composite material of the present invention is to be used as insulating roof sheathing, preferably the core will be made of polyurethane foam that is substantially devoid of filler. Generally speaking, the less filler, the greater the insulation value of polyurethane foam. The polyurethane foam preferably has a molded density of about 3 to 10 pcf, most preferably about 4 to 6 pcf. The laminate configuration preferably is paper/fiberglass scrim/paper. The preferred binding/stiffening resin is a polyester resin filled with glass microspheres. Preferably the glass microspheres constitute about 10 to 50 percent of the volume of the mixture of binder resin and microspheres, most preferably about 30 to 40 vol. %. The scrim preferably contains about 4 to 10 cords per linear inch, most preferably about 5 to 7 cords per linear inch. As far as the paper is concerned, preferably it has a basis weight of about 42 to 90 lbs., e.g., about 50-58 lb.

3. Making a Columnar Composite

Several different methods are contemplated for making a columnar composite.

Figure 7A:
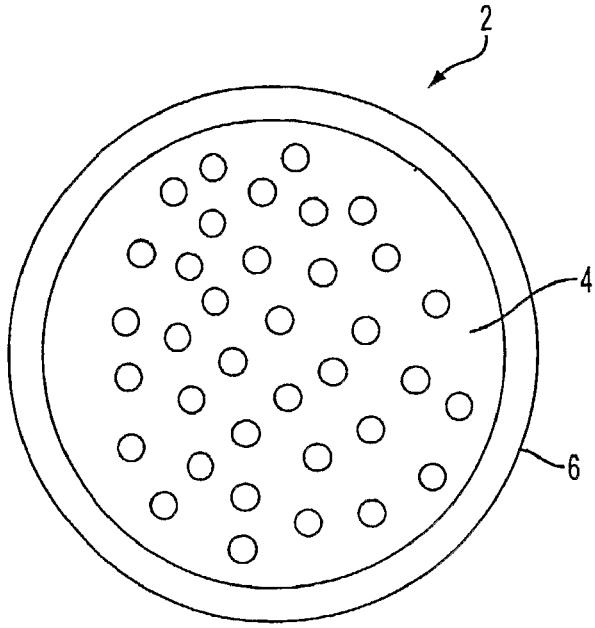
FIGS. 7A and 7B are cross-sectional views of preferred embodiments of a columnar composite of the present invention, wherein each cross section is taken perpendicularly to the axial direction of the composite.

To make the columnar composite shown in FIG. 7A, for example, the laminar covering 6 can be formed into a tubular configuration, similar to the way a cardboard paper towel roll is made, after which the core materials can be injected into the hollow space within the tube from one of the open ends.

Figure 7B:
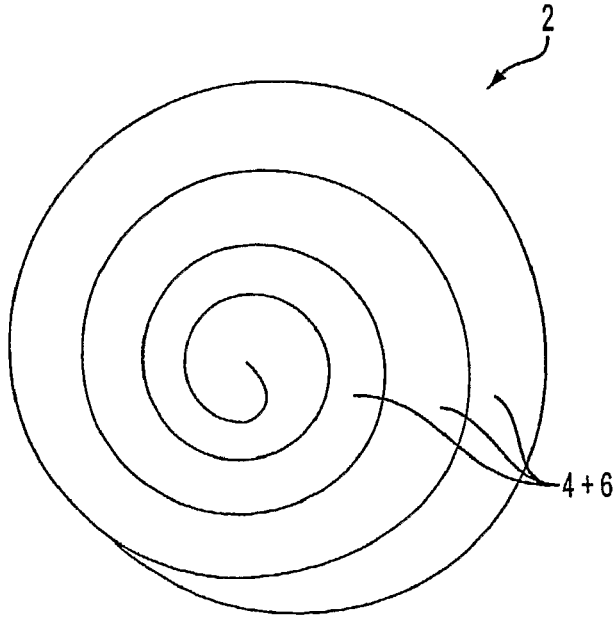

Also contemplated is the formation of a spiral-wound columnar composite, such as shown in FIG. 7B. This composite could be formed initially as a sheet-like material using the method of FIG. 5, then rolled up to any desired diameter while the composite is still malleable. Once cured, the binding/stiffening resins bond together adjacent turns in the spiral. Such spiral-wound composites will better withstand punctures through the outer layer of exoskeleton, because of the existence of additional composite thicknesses below the outer thickness of sheet-like composite. This makes the spiral-wound column more useful for telephone poles and the like, where workers must climb the poles in cleated shoes.

C. Shipping Pallet Example

As mentioned above, the present invention is ideally suited for the manufacture of composite boards used in the construction of shipping pallets. Any type of shipping pallet that can be constructed of wooden boards or blocks can be made using one or more composite boards or blocks of the present invention. As is well known in the art, such pallets typically have deck boards (arranged horizontally) and stringers (also sometimes called "runners" or "posts") arranged vertically under a top layer of deck boards. Use of a bottom deck is optional. Stringer pallets typically contain both edge and center stringers. Sometimes a single center stringer is used; but other times two center stringers will be used, e.g., either touching one another or separated by about 6 to 20 inches, to distribute the load evenly.

Instead of stringers, some pallets comprise blocks and connector boards, to which are nailed top and bottom deck boards.

All of the boards may be of various widths, lengths, and thicknesses. Typically, however, deck boards are 1×4 s or 1×6 s. Stringers are typically 2×4 s or 3×4 s. A typical block pallet might contain six outer blocks, three center blocks, three connector boards, four top deck boards that are approximately 1×4×40 inches, five top deck boards that are approximately 1×6×40 inches, three bottom deck boards that are approximately 1×6×37 inches, and two bottom deck boards that are approximately 1×6×40 inches.

A stringer pallet can be configured as a two-way pallet, wherein the stringers permit the entry of forklift tines from two opposite directions only. Alternatively, the pallet can be configured as a four-way pallet, wherein the stringers are notched, or otherwise cut, to permit entry of forklift tines from all four directions.

The deck and bottom boards in a stringer pallet can be flush with the outer edge of the outer stringers, making for a "flush pallet," or the deck and/or bottom boards can be extended past the outer edge of the outer stringers, making for a "single-wing" or "double-wing" pallet. Also, the bottom boards can be completely omitted, making for a "single-deck" or "skid" pallet.

If desired, the deck and bottom boards can be configured such that their number, size, and placement are the same, top and bottom, making for a "reversible" pallet.

A pallet can be constructed entirely or partly of composite boards and/or blocks in accordance with the present invention. The inventive composite boards and/or blocks could be incorporated in a conventional wooden pallet, possibly as a replacement for boards and/or blocks that have failed or as an upgrade for boards and/or blocks likely to fail. As an example, the upper and outermost deck boards, which are frequently damaged by forklift tines, could be made of the composite structural material, while the rest of the boards and/or blocks could be made of wood.

Figure 8:
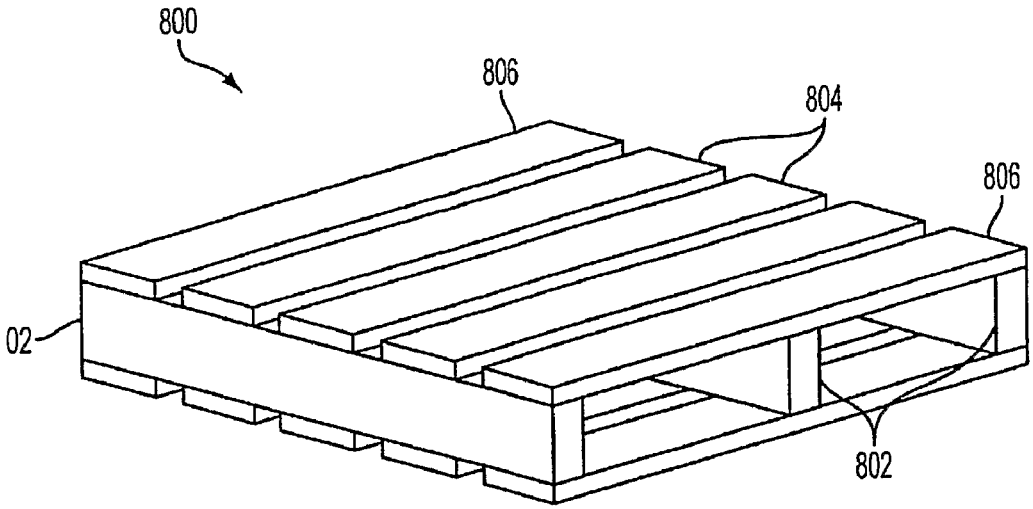
FIG. 8 is a perspective view of a preferred embodiment of a pallet constructed of composite boards of the present invention.

FIG. 8 illustrates a two-way pallet 800 constructed of stringers 802, standard deck boards 804, and leading-edge boards 806 made of a composite structural material in accordance with the present invention. The standard deck boards are interior boards. The leading-edge boards are outside edge boards that flank the interior boards. The leading-edge boards 806, which are the upper and outermost deck boards of the pallet, preferably have a denser core than the standard deck boards 804 and, consequently, tend to be more durable and rugged than the standard deck boards.

The standard deck boards 804 (top and bottom) and leading-edge boards 806 are held to the stringers 802 by Halstead gun nails, Product No. HOT 30131, and/or Halstead bulk nails, Product No. BOT 30131, both of which are high-grip, combination rink shank/drive screw nails having the following specifications:

- round, 0.295 to 0.305 inch diameter head
- head thickness of 0.065 to 0.070 inch
- countersink angle of 130°
- 2.9375 to 3.0625 inches in length
- ring shank width of 0.130 to 0.132 inch
- made from 0.120 inch diameter drawn, low carbon, steel wire
- diamond point with 42° angle
- minimum tensile strength (bend yield) of 100,000 psi
- coated with thermoplastic resin (a dried latex adhesive)

Preferably, the pallet is assembled using the Turbo 505 automated pallet assembly system available from Viking Inc.

1. Stringer

Each stringer 802 in this preferred embodiment measures about 2 inches wide by about 3.5 inches tall by about 48 inches long. It is contemplated that stringers having a width of less than about 2 inches, e.g., about 1.5 or 1.75 inches, could also be employed.

The stringer core comprises about 60 to 80 percent rubber, by volume, with the balance being polyurethane foam. The core preferably has a density of about 43 to 48 pcf.

The preferred rubber is ¼-inch crumb or smaller, obtained from either commercial or passenger tires. The rubber may include fluff, but preferably has substantially no metal content. The shipping density of the rubber is approximately 27 pcf, and its moisture content is no more than about 1.5 percent, by weight.

A preferred polyurethane system for forming the resinous core matrix is the Copps B-1000/A-1001 system, which yields a free rise density of about 32 to 34 pcf. The polyurethane foam preferably has a nail-pull-out resistance of at least about 200 lbs.

The laminar covering of the stringer preferably comprises five layers—two reinforcing layers, each sandwiched between a pair of paper layers. Beginning from the core side, the layers are, in order, $P_i$-RL-$P_m$-RL-$P_o$.

The outermost paper layer preferably is 33-percent recycled unbleached kraft linerboard having a basis weight of about 42 lbs, a thickness of about 10.2 mils, a burst strength of about 114 psi, a Sheffield rating of less than about 260, and a moisture content of less than about 8 percent, by weight.

Each inner paper layer preferably is 20-percent recycled unbleached kraft linerboard having a basis weight of about 90 lbs, a thickness of about 24.4 mils, a burst strength of about 176 psi, a Sheffield rating of less than about 260, and a moisture content of less than about 8 percent, by weight.

Alternatively, all of the paper layers could comprise paper having the same basis weight, e.g., 90 lbs.

Each reinforcing layer is the 1812P2/0.9GA product noted above, which is available from Scrimco, Inc.

The paper and reinforcing layers preferably are impregnated with and laminated together by the Copps A-900/B-900 epoxy resin system, mixed at a ratio of approximately 4.4 parts resin to one part hardener, by weight, or approximately 4.2 parts resin to one part hardener, by volume. The epoxy content in the laminar covering preferably is about 0.25 to 0.30 lbs per square foot, more preferably about 0.28 lbs per square foot.

The total thickness of the laminar covering preferably is no more than the sum of the individual plies of paper and reinforcing layers.

Optionally, the stringers can be provided with an external surface treatment, as described above, particularly if the epoxy does not fully permeate the outermost paper layer. Alternatively, the epoxy applied to the outermost paper layer can include one or more additives to give the resin-impregnated paper any desired properties. In either case, the cut ends of each stringer preferably are provided with about a 3 to 4 mil thick coating of a rubbery sealant that is suitable to prevent moisture from penetrating the core.

The stringer preferably has a density of about 50 to 97 pcf; a crush resistance of at least about 725 psi; a compression strength of at least 1,550 psi; a modulus of rupture of about 4,000 to 7,900 psi, e.g., about 5,000 to 6,000 psi; a modulus of elasticity of about $0.90\times10^6$ to $1.3\times10^6$, e.g., about $0.95\times10^6$ to $1.05\times10^6$; a fatigue rating of at least about 60 percent of original strength after 2,000,000 cycles; and a coefficient of linear thermal expansion of less than about $0.3\times10^{-5}$ inch per ° F.

2. Standard Deck Board

Each standard deck board 804 in this preferred embodiment measures about 0.7 inch thick by about 3.5 inches wide by about 40 inches long.

The standard deck board core preferably comprises at least about 20 volume percent, e.g., about 40 to 60 volume percent, of pumice, with the balance being a foamed thermosetting resin, preferably a polyurethane foam. The core preferably has a density of about 11 to 15 pcf.

The pumice preferably is about ¼ inch (#8 sieve) in size and has a loose density of about 4.5 to 5.0 pcf.

Because the deck boards usually do not have to be dense enough to tightly hold a nail, the core of the deck boards can also be made without any filler solids. For example, they might be made with a core material consisting entirely of polyurethane foam. To keep their weight down, preferably they contain no more than about 10 volume percent of rubber tire particles.

A preferred polyurethane system for forming the resinous core matrix is the Copps B-1000/A-1000 system, which yields a free rise density of about 14 to 17 pcf. The polyurethane foam preferably has a nail-pull-out resistance of at least about 25 lbs.

The laminar covering of the standard deck board preferably comprises four layers—two adjacent reinforcing layers in between two paper layers. Beginning from the core side, the layers are, in order, $P_i$-RL-RL-$P_o$. Alternatively, the laminar covering could comprise a single reinforcing layer sandwiched between two paper layers. The laminar covering preferably has a tensile strength of at least about 800 pli, e.g., about 1,200 to 1,400 pli, as measured by ASTM D 638.

The outermost paper layer preferably is the same as the outermost paper layer described above for the stringers, and the inner paper layer preferably is the same as the inner paper layers described above for the stringers. The reinforcing layers and the epoxy binder preferably are also the same as those described above for the stringers. The epoxy content in the laminar covering preferably is about 0.20 to 0.25 lb per square foot, more preferably about 0.21 to 0.23 lb per square foot.

The standard deck board preferably has a density of about 45 pcf or less, e.g., about 20 to 45 pcf; a crush resistance of at least about 650 psi; a compression strength of about 1,200 to 1,500 psi; a modulus of rupture of about 2,400 to 5,700 psi, e.g., about 4,300 to 4,700 psi; a modulus of elasticity of about $0.75\times10^6$ to $1.1\times10^{-6}$, e.g., about $0.90\times10^6$ to $1.0\times10^6$; a fatigue rating of at least about 60 percent of original strength after 2,000,000 cycles; and a coefficient of linear thermal expansion of less than about $0.3\times10^{-5}$ inch per ° F. Preferably the matrix resin in the board's core is foamed polyurethane having a molded density of about 12 to 17 pcf, e.g., about 13 to 15 pcf.

3. Leading-Edge Board

The leading-edge boards 806 in this preferred embodiment are substantially the same as the standard deck boards described above, except that the leading-edge board measures about 5.5 inches wide and has a different core content. Its core preferably contains 0 to about 40 volume percent crumb rubber and 0 to about 30 volume percent pumice, with the balance being polyurethane foam. Preferably the rubber content is at least about 15 volume percent, e.g., in the range of about 25 to 35 volume percent, and the pumice content is not more than about 10 volume percent. Preferably the polyurethane foam has a molded density of about 14 to 34 pcf, e.g., about 18 to 32 pcf. The leading-edge board core preferably has an overall density of about 18 to 32 pcf. Thus, for example, the core might contain about 30 volume percent rubber, with the balance being polyurethane foam having a molded density of about 30 pcf.

The leading-edge board preferably has a density of about 38 to 55 pcf; a crush resistance of at least about 750 psi; a compression strength of about 1,400 to 1,700 psi; a modulus of rupture of about 2,400 to 7,900 psi, e.g., about 4,800 to 5,000 psi; a modulus of elasticity of about $0.75\times10^6$ to $1.3\times10^6$, e.g., about $0.95\times10^6$ to $1.1\times10^6$; a fatigue rating of at least 60 percent of original strength after 2,000,000 cycles; and a coefficient of linear thermal expansion of less than about $0.3\times10^{-5}$ inch per ° F.

4. Further Optional Features

Figure 9:
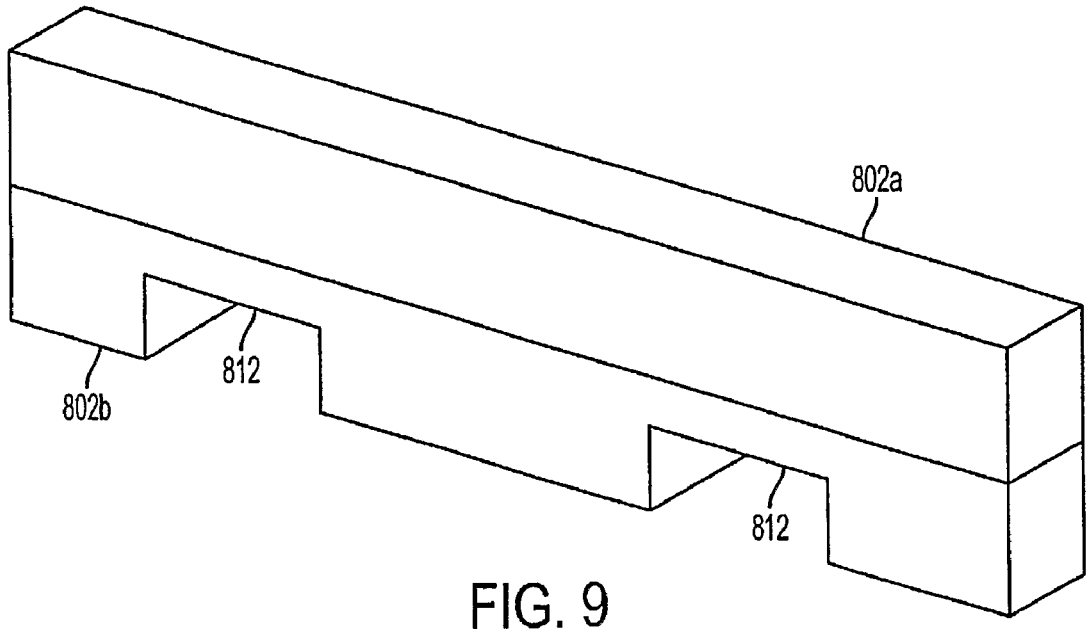
FIG. 9 is a perspective view of an outermost pallet stringer of the present invention.
Figure 10:
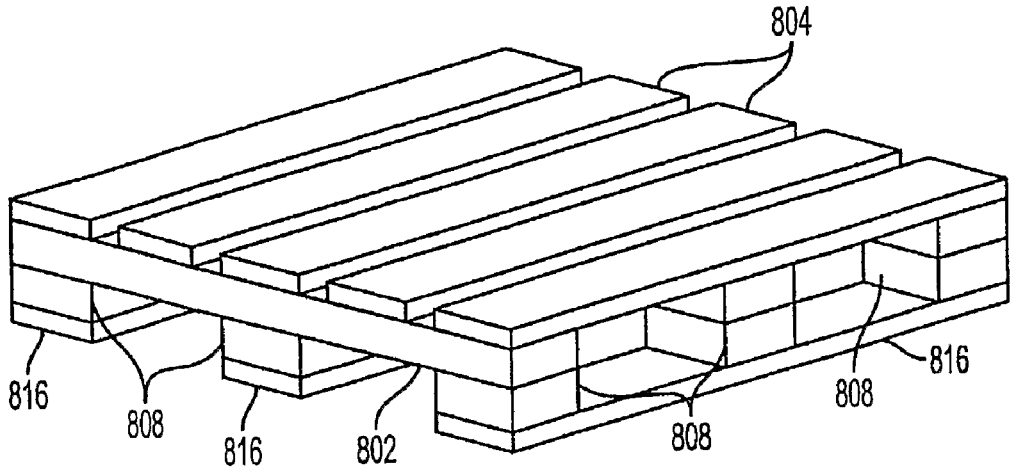
FIG. 10 is a perspective view of another preferred embodiment of a pallet constructed of composite boards of the present invention.
Figure 13:
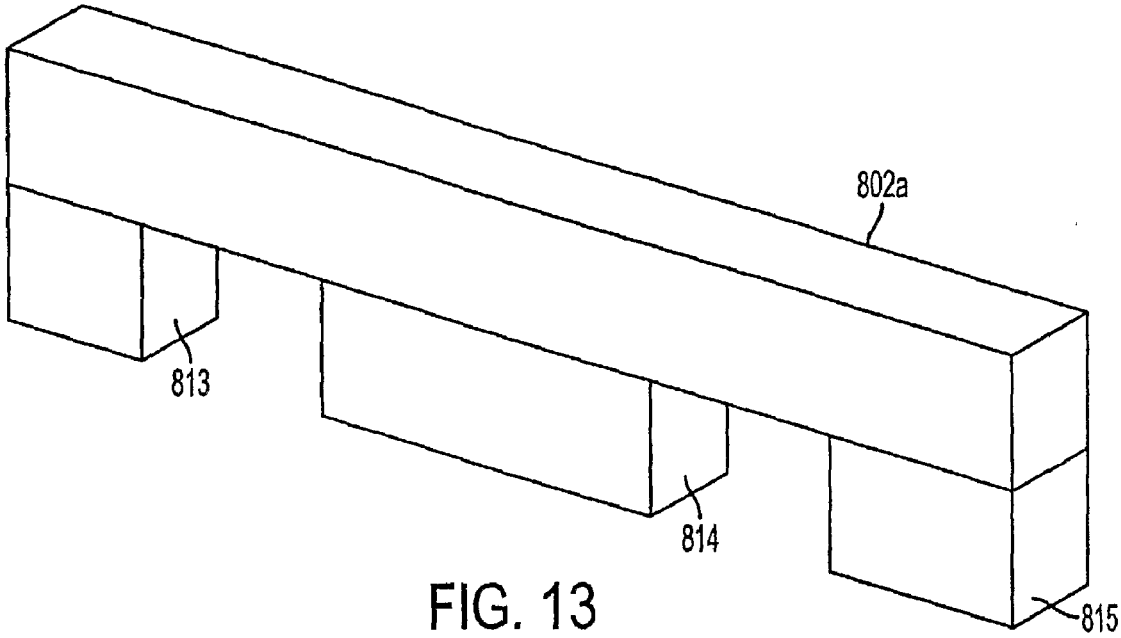
FIG. 13 is a perspective view of another outermost pallet stringer of the present invention.

In a four-way pallet it is necessary to provide notches or openings in the outermost stringers to accommodate forklift tines. Simply cutting notches in the stringer described above, however, could compromise the strength of the laminar covering in the vicinity of the notches. One approach is to make a bifurcated stringer out of two 2 inch×1.75 inch stringer boards 802*a* and 802*b* that are held together by glue or the like, as illustrated in FIG. 9. The lower board 802*b* has two notches 812 cut therein to accommodate forklift tines. Alternatively, as shown in FIG. 13, the top board 802*a* can be adhered to three blocks 813, 814, and 815. Another approach is to lay a standard 2"×3.5" upper stringer 802 on its side (as opposed to on its edge) and glue 2"×3.5" blocks 808 to the stringer at spaced intervals, as illustrated in FIG. 10. For added stability a deck board 816 can be fastened to the underside of each row of blocks 808. In all of these embodiments the boards and blocks can be made out of the composite of the present invention.

Figure 11:
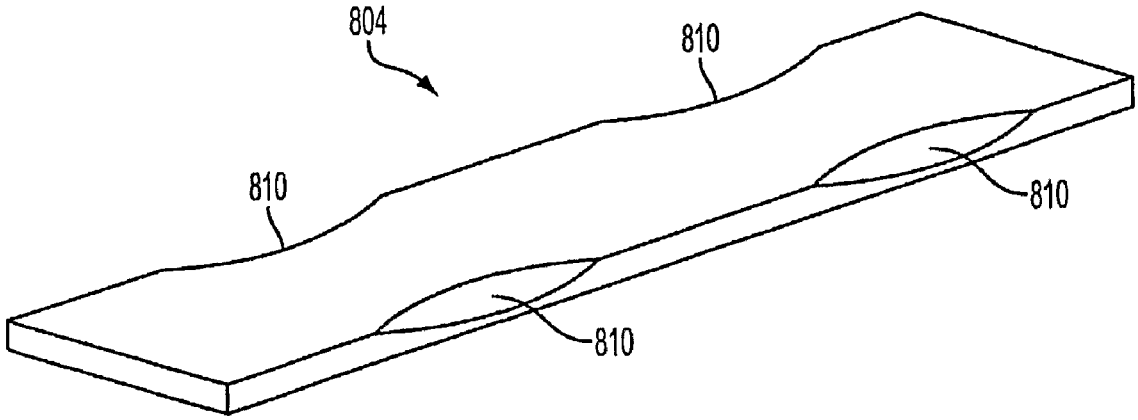
FIG. 11 is a perspective view of another preferred embodiment of a composite board of the present invention.

Each of the lower and outermost deck boards optionally may include four 12-inch chamfers 810 along their upper edges, as shown in FIG. 11. The chamfers preferably are inclined at an angle of about 35 to 45 degrees, and are located about 0.25 inch above the lower edges of the boards. The chamfer can be made, for example, by forming a crush in the composite before it is completely rigid, or by cutting the chamfers into the finished board using a router or the like.

D. Further Applications for the Composite Structural Material

The composite structural material of the present invention is generally suitable as a substitute for lumber in many different applications, non-limiting examples of which are mentioned below. The composite structural material is generally more durable, insulative, water resistant, and better able to hold a nail than wood.

Some potential applications for the composite structural material include use as wallboard, including sheer walls and sound walls, roofing, flooring, decking, guard rail posts, telephone poles, sign posts, range fencing, decorative fencing, paddocks, cable spools, pallets, container flooring, tractor trailer flooring, scaffolding boards, marine pilings, railroad ties, playground equipment, and disaster relief shelters, to name a few.

One of the advantages of the composite structural material is that it is customizable to meet different specifications. For example, a highway guard rail post made according to the present invention could be designed to yield if impacted by a predetermined force, as dictated by highway safety administration standards.

Although specific embodiments of the present invention have been described above in detail, it will be understood that this description is merely for purposes of illustration. Various modifications of and equivalent structures corresponding to the disclosed aspects of the preferred embodiments described above may be made by those skilled in the art without departing from the spirit of the present invention.

What is claimed is:

1. A shipping pallet comprising:

a plurality of stringer boards or blocks; and a plurality of composite upper-deck boards fastened to the stringer boards or blocks, the composite upper-deck boards including two outside-edge boards that flank a plurality of interior boards, each of the composite upper-deck boards comprising a dimensionally stable core material ensheathed in a dimensionally stable covering that is bonded to the core material, wherein the core material of each of the interior deck boards has a lesser crush resistance and lower density than the crush resistance and density of either of the outside-edge boards that flank those interior boards.

2. The shipping pallet of claim 1, wherein each of the outer-edge upper-deck boards has a crush resistance of at least about 750 psi.

3. The shipping pallet of claim 2, wherein each of the interior upper-deck boards has a density of about 30 to 55 $lb/ft^3$.

4. The shipping pallet of claim 3, wherein the core material of each of the interior upper-deck boards comprises at least about 20 volume percent of pumice dispersed in a matrix of a foamed thermosetting resin.

5. The shipping pallet of claim 4, wherein the core material of each of the outside-edge upper-deck boards comprises at least about 15 volume percent of rubber tire particles dispersed in a matrix of a foamed thermosetting resin.

6. The shipping pallet of claim 5, wherein the core material of each of the interior upper-deck boards contains no more than about 10 volume percent of rubber tire particles.

7. The shipping pallet of claim 6, wherein the foamed thermosetting resin matrix in each of the upper-deck boards is a polyurethane resin.

8. The shipping pallet of claim 7, wherein the foamed polyurethane resin in the core material of the interior upper-deck boards has a molded density of about 12 to 17 $lb/ft^3$.

9. The shipping pallet of claim 8, wherein the foamed polyurethane resin in the core material of the outside-edge upper-deck boards has a molded density of about 14 to 34 $lb/ft^3$.

10. The shipping pallet of claim 9, wherein about 40 to 60 percent of the volume of the core material of each of the interior upper-deck boards is occupied by pumice, and about 25 to 35 percent of the volume of the core material of each of the outside-edge upper-deck boards is occupied by rubber tire particles.

11. A method of making an elongated, composite, structural material, comprising the following steps:

a) forming a foldable laminate of two strips of porous web material selected from the group consisting of paper and cloth, with at least one strip of a band of reinforcing cords sandwiched there between, with the cords running in the lengthwise direction and with the strips of porous web material and all materials lying between those strips being impregnated with a thermosetting resin-precursor mixture;

b) folding the laminate into a trough shape and orienting it horizontally, with one of the strips of porous web material on the top and the other strip of porous web material on the bottom;

c) depositing in the trough of the laminate, while still foldable, a fluid matrix-resin-precursor composition that is compatible with the resin-precursor mixture in the laminate and which, when fully reacted, yields a thermoset matrix resin that is at least semi-rigid;

d) folding closed and sealing shut the laminate so that it surrounds and defines a core space containing the matrix-resin precursor composition; and e) holding the closed laminate and its contents in a mold under conditions conducive to the setting of both the thermosetting resin in the laminate and the matrix resin in the core space, for a time sufficient for both resins to sufficiently set that (i) the laminate and the matrix resin are both made at least semi-rigid, (ii) the matrix resin, together with any filler solid it may contain, fills the core space, and (iii) the laminate and matrix resin are bonded together, wherein at least one side of the strip of porous web material that is positioned on the bottom is coated with a film of synthetic resin before it is impregnated with the thermosetting-resin-precursor mixture, and the web material is oriented so that its resin-coated side faces down with respect to the horizontal orientation of the troughshaped laminate during steps b and c, the film of synthetic resin being adequate to substantially prevent any ingredients of the thermosetting-resin-precursor mixture from bleeding through the porous web material.

12. The method of claim 11, wherein the porous web material is paper, the thermosetting-resin-precursor mixture is a mixture that reacts to form an epoxy resin, and the film of synthetic resin is a layer of polypropylene that is about 1 to 5 mils thick.

13. A method of making an elongated, composite, structural material, comprising the following steps:

a) forming a foldable laminate of two strips of porous web material selected from the group consisting of paper and cloth, with at least one strip of a band of reinforcing cords sandwiched therebetween, with the cords running in the lengthwise direction and with the strips of porous web material and all materials lying between those strips being impregnated with a thermosetting resin-precursor mixture;

b) folding the laminate into a trough shape and orienting it horizontally, with one of the strips of porous web material on the top and the other strip of porous web material on the bottom;

c) depositing in the trough of the laminate, while still foldable, a fluid polyurethane-resin-precursor composition that is compatible with the resin-precursor mixture in the laminate and which, when fully reacted, yields a foamed polyurethane resin that is at least semi-rigid;

d) folding closed and sealing shut the laminate so that it surrounds and defines a core space containing the polyurethane resin-precursor composition; and e) holding the closed laminate and its contents in a mold under conditions conducive to the setting of both the thermosetting resin in the laminate and the polyurethane resin in the core space, for a time sufficient for both resins to sufficiently set that (i) the laminate and the foamed polyurethane resin are both made at least semi-rigid, (ii) the foamed polyurethane resin, together with any filler solid it may contain, fills the core space, and (iii) the laminate and foamed polyurethane resin are bonded together, wherein the top strip of porous web material is conveyed through a dehumidification zone prior to impregnating it with the thermosetting resin-precursor mixture and prior to forming the foldable laminate in step a.

14. The method of claim 13, wherein the top strip of porous web material is paper, and when said strip of paper exits the dehumidification zone its moisture content is about 5 wt. % or less.

15. The method of claim 14, wherein the top strip of porous web material exits the dehumidification zone at a moisture content in the range of about 1 to 4 wt. %.

16. A shipping pallet comprising:

a plurality of stringer boards or blocks; and a plurality of composite upper-deck boards fastened to the stringer boards or blocks, the composite upper-deck boards including two outside-edge boards that flank a plurality of interior boards, each of the composite upper-deck boards comprising a dimensionally stable core material ensheathed in a dimensionally stable covering that is bonded to the core material, the covering comprising rigidified paper with high density polyethylene at a surface of the rigidified paper that is opposite a surface of the rigidified paper that faces the core material, wherein the core material of at least one of the upper-deck boards has a lesser crush resistance and lower density than the crush resistance and density of the stringer boards and blocks.

17. The shipping pallet of claim 1, further comprising at least one upper-deck board made from wood.

18. The shipping pallet of claim 1, wherein the core material includes crumb rubber.

19. The shipping pallet of claim 1, wherein the core material includes recycled high density polyethylene.

20. The shipping pallet of claim 1, wherein the core material includes wax.

21. The shipping pallet of claim 1, wherein the core material includes silicate.

* * * * *